US011437745B2

(12) United States Patent
Yeh et al.

(10) Patent No.: US 11,437,745 B2
(45) Date of Patent: Sep. 6, 2022

(54) CARD CONNECTOR

(71) Applicant: V-GENERAL TECHNOLOGY CO., LTD., New Taipei (TW)

(72) Inventors: Po-Wen Yeh, New Taipei (TW); Hsuan Ho Chung, New Taipei (TW); Yung-Chang Lin, New Taipei (TW); Yu Hung Lin, New Taipei (TW); Tzu-Wei Yeh, New Taipei (TW); Yu-Lun Yeh, New Taipei (TW)

(73) Assignee: V-GENERAL TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 17/349,876

(22) Filed: Jun. 16, 2021

(65) Prior Publication Data

US 2021/0408705 A1 Dec. 30, 2021

(30) Foreign Application Priority Data

Jun. 24, 2020 (TW) ..... 109121564

(51) Int. Cl.
*H01R 12/71* (2011.01)
*H01R 13/02* (2006.01)
(Continued)

(52) U.S. Cl.
CPC ..... *H01R 12/716* (2013.01); *H01R 12/57* (2013.01); *H01R 12/7088* (2013.01);
(Continued)

(58) Field of Classification Search
CPC .. H01R 12/716; H01R 12/57; H01R 12/7088; H01R 13/02; H01R 13/6581; H01R 2107/00
See application file for complete search history.

(56) References Cited

U.S. PATENT DOCUMENTS 8,142,207 B1 * 3/2012 Ljubijankic ..... H01R 13/6473 439/95
8,696,370 B1 * 4/2014 Lin ..... G06K 13/0806 439/159
(Continued)

*Primary Examiner* — Abdullah A Riyami
*Assistant Examiner* — Nelson R. Burgos-Guntin
(74) *Attorney, Agent, or Firm* — Leong C. Lei

(57) ABSTRACT

A card connector includes a transmission conductor assembly. The transmission conductor assembly includes a first conductor group and a second conductor group. The first conductor group includes a backup transmission conductor, first and second signal transmission conductors, an inspection signal transmission conductor, first to seventh grounding transmission conductors, a command reset transmission conductor, first to sixth differential transmission conductors, first and second power transmission conductors, and a write-protection transmission conductor, each of which has two ends respectively forming a spring section and a soldering section. The second conductor group includes eighth to tenth grounding transmission conductors, seventh to tenth differential transmission conductors, and a third power transmission conductor each of which has two ends respectively forming a spring section and a soldering section. The soldering sections, being so arranged, achieve advantages of bettering high frequency performance, reducing capacitive effect, and suppressing electromagnetic radiation interference.

10 Claims, 12 Drawing Sheets

(51) Int. Cl.
*H01R 12/57* (2011.01)
*H01R 12/70* (2011.01)
*H01R 13/6581* (2011.01)
*H01R 107/00* (2006.01)

(52) U.S. Cl.
CPC ..... *H01R 13/02* (2013.01); *H01R 13/6581* (2013.01); *H01R 2107/00* (2013.01)

(56) References Cited

U.S. PATENT DOCUMENTS 10,958,005 B1 * 3/2021 Dube ..... H01R 12/737
11,264,748 B2 * 3/2022 McClelland, II .. H01R 12/7082
2001/0010983 A1 * 8/2001 Bricaud ..... G06K 7/0013 439/630
2004/0127081 A1 * 7/2004 Chou ..... G06K 7/0043 439/188
2005/0227520 A1 * 10/2005 Wu ..... G06K 7/0021 439/159
2009/0093136 A1 * 4/2009 Hiew ..... H01R 12/57 439/55
2009/0111288 A1 * 4/2009 Harada ..... H01R 12/714 439/59
2009/0142948 A1 * 6/2009 Yu ..... H01R 12/714 439/135
2009/0286416 A1 * 11/2009 Wu ..... H01R 12/7094 439/328
2011/0130029 A1 * 6/2011 Yoshida ..... G06K 7/0047 439/485
2012/0108091 A1 * 5/2012 Takai ..... G06K 7/0043 439/153
2012/0231647 A1 * 9/2012 Yu ..... H01R 12/716 439/325
2012/0252276 A1 * 10/2012 Zhu ..... H01R 12/716 439/630
2013/0017731 A1 * 1/2013 Huang ..... H01R 25/006 439/629
2014/0009671 A1 * 1/2014 Ozone ..... H04N 5/23212 348/370
2015/0207249 A1 * 7/2015 Huang ..... G06K 13/0862 439/347
2016/0006173 A1 * 1/2016 Wang ..... H01R 13/245 439/157
2016/0111801 A1 * 4/2016 Zeng ..... H01R 12/7076 439/660
2016/0118733 A1 * 4/2016 Tanaka ..... G06K 7/04 439/629
2017/0179659 A1 * 6/2017 Motohashi ..... H04B 1/3816
2018/0138614 A1 * 5/2018 Zhao ..... H01R 13/5219
2018/0175551 A1 * 6/2018 Yamachika ..... H01R 13/635
2018/0219335 A1 * 8/2018 Chen ..... H04B 1/3818
2019/0272453 A1 * 9/2019 Argyres ..... H01R 13/24
2020/0076132 A1 * 3/2020 Yang ..... H01R 12/73
2020/0195288 A1 * 6/2020 Wang ..... H01R 12/71
2020/0274267 A1 * 8/2020 Zerebilov ..... H01R 13/6581
2020/0350733 A1 * 11/2020 Yang ..... H01R 13/6595
2020/0395698 A1 * 12/2020 Hou ..... H01R 13/6477
2020/0403341 A1 * 12/2020 Zhang ..... G06K 7/0052
2021/0091492 A1 * 3/2021 Park ..... G06K 13/0831
2021/0257785 A1 * 8/2021 Shah ..... H01R 12/72
2021/0399481 A1 * 12/2021 Yeh ..... H01R 13/6585
2021/0399482 A1 * 12/2021 Yeh ..... H01R 12/716
2021/0408705 A1 * 12/2021 Yeh ..... H01R 12/57
2022/0037836 A1 * 2/2022 Huang ..... H01R 13/6585

* cited by examiner

CARD CONNECTOR

TECHNICAL FIELD OF THE INVENTION

The present invention relates to a card connector, and more particularly to a card connector featuring bettered high frequency performance, reduced capacitive effect, and suppressed electromagnetic radiation interference.

DESCRIPTION OF THE PRIOR ART

Security Digital, commonly abbreviated as SD, refers to a memory card, which is widely used in portable devices, such as digital cameras, personal digital assistants (PDAs), and multimedia players. SD technology is based on the MultiMediaCard (MMC) format. The SD card has a relatively high data transmission rate and is constantly updating the standards thereof. Most of the SD cards are provided with, on a lateral side thereof, with write protection control to prevent accidental data writing in the card. Some of the SD cards even support digital copyright management technology. The size of the SD cards is relatively small and consequently, multiple terminal sets must be included in an SD receptacle and the terminal sets are close to each other, making it easy to induce mutual interference and capacitive effect therebetween.

Particularly, for the demand of high speed in the contemporary era, the number of terminals included in an SD card is constantly increased, such as SD 8.0. As a result, the mutual interference issue of the terminal sets is becoming increasingly troublesome.

SUMMARY OF THE INVENTION

The primary objective of the present invention is to realize advantages of bettering high frequency performance, reducing the capacitive effect, and suppressing electromagnetic radiation interference by providing an arrangement of soldering sections.

To achieve the above objective, a main structure of the present invention comprises a transmission conductor assembly. The transmission conductor assembly comprises a first conductor group and a second conductor group arranged at one side of the first conductor group, wherein the first conductor group comprises a backup transmission conductor, a first signal transmission conductor, an inspection signal transmission conductor, a first grounding transmission conductor, a command reset transmission conductor, a first differential transmission conductor, a second differential transmission conductor, a second grounding transmission conductor, a third grounding transmission conductor, a fourth grounding transmission conductor, a first power transmission conductor, a second power transmission conductor, a third differential transmission conductor, a fourth differential transmission conductor, a second signal transmission conductor, a fifth grounding transmission conductor, a sixth grounding transmission conductor, a seventh grounding transmission conductor, a fifth differential transmission conductor, a sixth differential transmission conductor, and a write-protection transmission conductor; and the second conductor group comprises an eighth grounding transmission conductor, a seventh differential transmission conductor, an eighth differential transmission conductor, a ninth grounding transmission conductor, a third power transmission conductor, and a ninth differential transmission conductor, a tenth differential transmission conductor, and a tenth grounding transmission conductor;

wherein the first signal transmission conductor has two ends that are extended to respectively form a first signal soldering section and a first signal spring section, and the first signal soldering section is located at one side of the backup soldering section;

the inspection signal transmission conductor has two ends that are extended to respectively form an inspection signal soldering section and an inspection signal spring section, and the inspection signal soldering section is located at one side of the first signal soldering section that is distant from the backup soldering section, the inspection signal spring section is located at one side of the first signal spring section;

the first grounding transmission conductor has two ends that are extended to respectively form a first grounding soldering section and a first grounding spring section, and the first grounding soldering section is located at one side of the inspection signal soldering section that is distant from the first signal soldering section, and the first grounding spring section is located at one side of the backup spring section;

the command reset transmission conductor has two ends that are extended to respectively form a command reset soldering section and a command reset spring section, and the command reset soldering section is located at one side of the first grounding soldering section that is distant from the inspection signal soldering section, and the command reset spring section is located at one side of the inspection signal spring section that is distant from the first signal spring section;

the first differential transmission conductor has two ends that are extended to respectively form a first differential soldering section and a first differential spring section, and the first differential soldering section is located at one side of the command reset soldering section that is distant from the first grounding soldering section, and the first differential spring section is located at one side of the first grounding spring section;

the second differential transmission conductor has two ends that are extended to respectively form a second differential soldering section and a second differential spring section, and the second differential soldering section is located at one side of the first differential soldering section that is distant from the command reset soldering section, and the second differential spring section is located at one side of the first differential spring section that is distant from the first grounding spring section; the second grounding transmission conductor has two ends that are extended to respectively form a second grounding soldering section and a second grounding spring section, and the second grounding soldering section is located at one side of the second differential soldering section that is distant from the first differential soldering section, and the second grounding spring section is located at one side of the command reset spring section that is distant from the inspection signal spring section;

the third grounding transmission conductor has two ends that are extended to respectively form a third grounding soldering section and a third grounding spring section, and the third grounding soldering section is located at one side of the second grounding soldering section that is distant from the second differential soldering section, and the third grounding spring section is located at one side of the second differential spring section that is distant from the first differential spring section;

the fourth grounding transmission conductor has two ends that are extended to respectively form a fourth grounding soldering section and a fourth grounding spring section, and the fourth grounding soldering section is located at one side of the third grounding soldering section that is distant from the second grounding soldering section, and the fourth grounding spring section is located at one side of the second grounding spring section that is distant from the command reset spring section;

the first power transmission conductor has two ends that are extended to respectively form a first power soldering section and a first power spring section, and the first power soldering section is located at one side of the fourth grounding soldering section that is distant from the third grounding soldering section, and the first power spring section is located at one side of the third grounding spring section that is distant from the second differential spring section;

the second power transmission conductor has two ends that are extended to respectively form a second power soldering section and a second power spring section, and the second power soldering section is located at one side of the first power soldering section that is distant from the fourth grounding soldering section, and the second power spring section is located at one side of the fourth grounding spring section that is distant from the second grounding spring section;

the third differential transmission conductor has two ends that are extended to respectively form a third differential soldering section and a third differential spring section, and the third differential soldering section is located at one side of the second power soldering section that is distant from the first power soldering section, and the third differential spring section is located at one side of the first power spring section that is distant from the third grounding spring section;

the fourth differential transmission conductor has two ends that are extended to respectively form a fourth differential soldering section and a fourth differential spring section, and the fourth differential soldering section is located at one side of the third differential soldering section that is distant from the second power soldering section, and the fourth differential spring section is located at one side of the third differential spring section that is distant from the first power spring section;

the second signal transmission conductor has two ends that are extended to respectively form a second signal soldering section and a second signal spring section, and the second signal soldering section is located at one side of the fourth differential soldering section that is distant from the third differential soldering section, and the second signal spring section is located at one side of the second power spring section that is distant from the fourth grounding spring section;

the fifth grounding transmission conductor has two ends that are extended to respectively form a fifth grounding soldering section and a fifth grounding spring section, and the fifth grounding soldering section is located at one side of the second signal soldering section that is distant from the fourth differential soldering section, the fifth grounding spring section is located at one side of the fourth differential spring section that is distant from the third differential spring section;

the sixth grounding transmission conductor has two ends that are extended to respectively form a sixth grounding soldering section and a sixth grounding spring section, and the sixth grounding soldering section is located at one side of the fifth grounding soldering section that is distant from the second signal soldering section, and the sixth grounding spring section is located at one side of the second signal spring section that is distant from the second power spring section;

the seventh grounding transmission conductor has two ends that are extended to respectively form a seventh grounding soldering section and a seventh grounding spring section, and the seventh grounding soldering section is located at one side of the sixth grounding soldering section that is distant from the fifth grounding soldering section, and the seventh grounding spring section is located at one side of the fifth grounding spring section that is distant from the fourth differential spring section;

the fifth differential transmission conductor has two ends that are extended to respectively form a fifth differential soldering section and a fifth differential spring section, and the fifth differential soldering section is located at one side of the seventh grounding soldering section that is distant from the sixth grounding soldering section, and the fifth differential spring section is located at one side of the sixth grounding spring section that is distant from the second signal spring section;

the sixth differential transmission conductor has two ends that are extended to respectively form a sixth differential soldering section and a sixth differential spring section, and the sixth differential soldering section is located at one side of the fifth differential soldering section that is distant from the seventh grounding soldering section, and the sixth differential spring section is located at one side of the fifth differential spring section that is distant from the sixth grounding spring section;

the write-protection transmission conductor has two ends that are extended to respectively form a write-protection grounding soldering section and a write-protection spring section, and the write-protection grounding soldering section is located at one side of the sixth differential soldering section that is distant from the fifth differential soldering section, and the write-protection spring section is located at one side of the seventh grounding spring section that is distant from the fifth grounding spring section;

the eighth grounding transmission conductor has two ends that are extended to respectively form an eighth grounding soldering section and an eighth grounding spring section;

the seventh differential transmission conductor has two ends that are extended to respectively form a seventh differential soldering section and a seventh differential spring section, and the seventh differential soldering section is located at one side of the eighth grounding soldering section, and the seventh differential spring section is located at one side of the eighth grounding spring section;

the eighth differential transmission conductor has two ends that are extended to respectively form an eighth differential soldering section and an eighth differential spring section, and the eighth differential soldering section is located at one side of the seventh differential soldering section that is distant from the eighth grounding soldering section, and the eighth differential spring section is located at one side of the seventh differential spring section that is distant from the eighth grounding spring section;

the ninth grounding transmission conductor has two ends that are extended to respectively form a ninth grounding soldering section and a ninth grounding spring section, and the ninth grounding soldering section is located at one side of the eighth differential soldering section that is distant from the seventh differential soldering section, and the ninth grounding spring section is located at one side of the eighth differential spring section that is distant from the seventh differential spring section;

the third power transmission conductor has two ends that are extended to respectively form a third power soldering section and a third power spring section, and the third power soldering section is located at one side of the ninth grounding soldering section that is distant from the eighth differential soldering section, and the third power spring section is located at one side of the ninth grounding spring section that is distant from the eighth differential spring section;

the ninth differential transmission conductor has two ends that are extended to respectively form a ninth differential soldering section and a ninth differential spring section, and the ninth differential soldering section is located at one side of the third power soldering section that is distant from the ninth grounding soldering section, and the ninth differential spring section is located at one side of the third power spring section that is distant from the ninth grounding spring section;

the tenth differential transmission conductor has two ends that are extended to respectively form a tenth differential soldering section and a tenth differential spring section, and the tenth differential soldering section is located at one side of the ninth differential soldering section that is distant from the third power soldering section, and the tenth differential spring section is located at one side of the ninth differential spring section that is distant from the third power spring section; and the tenth grounding transmission conductor has two ends that are extended to respectively form a tenth grounding soldering section and a tenth grounding spring section, and the tenth grounding soldering section is located at one side of the tenth differential soldering section that is distant from the ninth differential soldering section, and the tenth grounding spring section is located at one side of the tenth differential spring section that is distant from the ninth differential spring section.

Based on the above structure, the first differential soldering section and the second differential soldering section, the third differential soldering section and the fourth differential soldering section, the fifth differential soldering section and the sixth differential soldering section, the seventh differential soldering section and the eighth differential soldering section, and the ninth differential soldering section and the tenth differential soldering section are arranged side by side in a pairwise form, and the third grounding soldering section is arranged between the first and the second differential soldering sections and the third and fourth differential soldering sections; and the fifth grounding soldering section and the sixth grounding soldering section are arranged between the third and fourth differential soldering sections and the fifth and sixth differential soldering sections; and the ninth grounding transmission conductor is arranged between the seventh and eighth differential soldering sections and the ninth and tenth differential soldering sections, so that capacitive effect can be reduced and thus bettering of the high frequency performance and suppressing of electromagnetic radiation interference can be realized.

DETAILED DESCRIPTION OF THE PREFERRED EMBODIMENT

Figure 1:
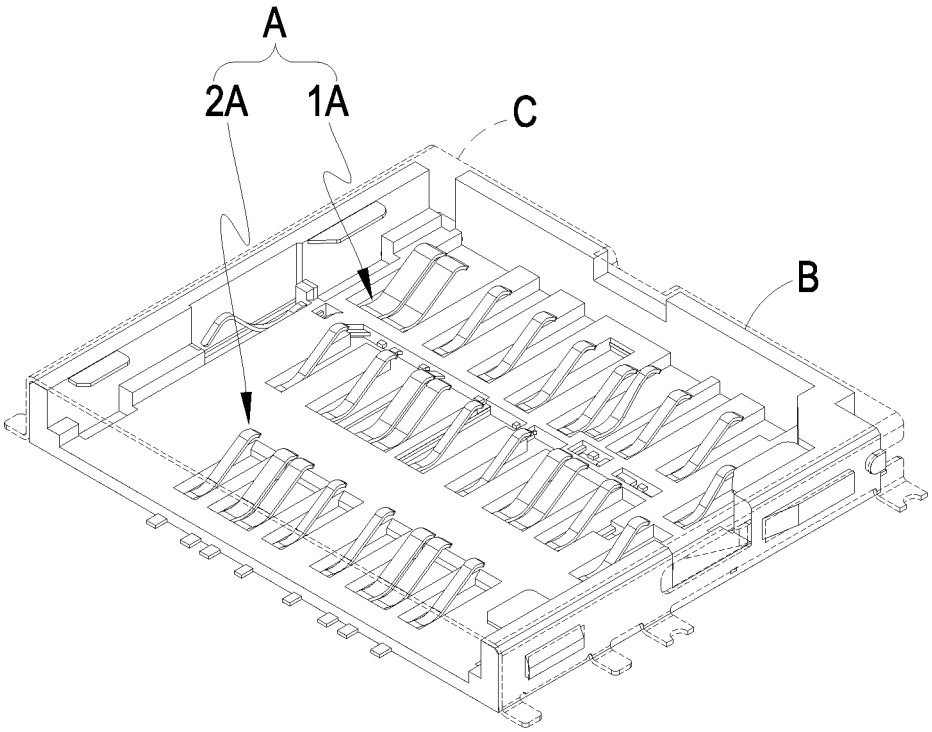
FIG. 1 is a perspective view showing the present invention.
Figure 2:
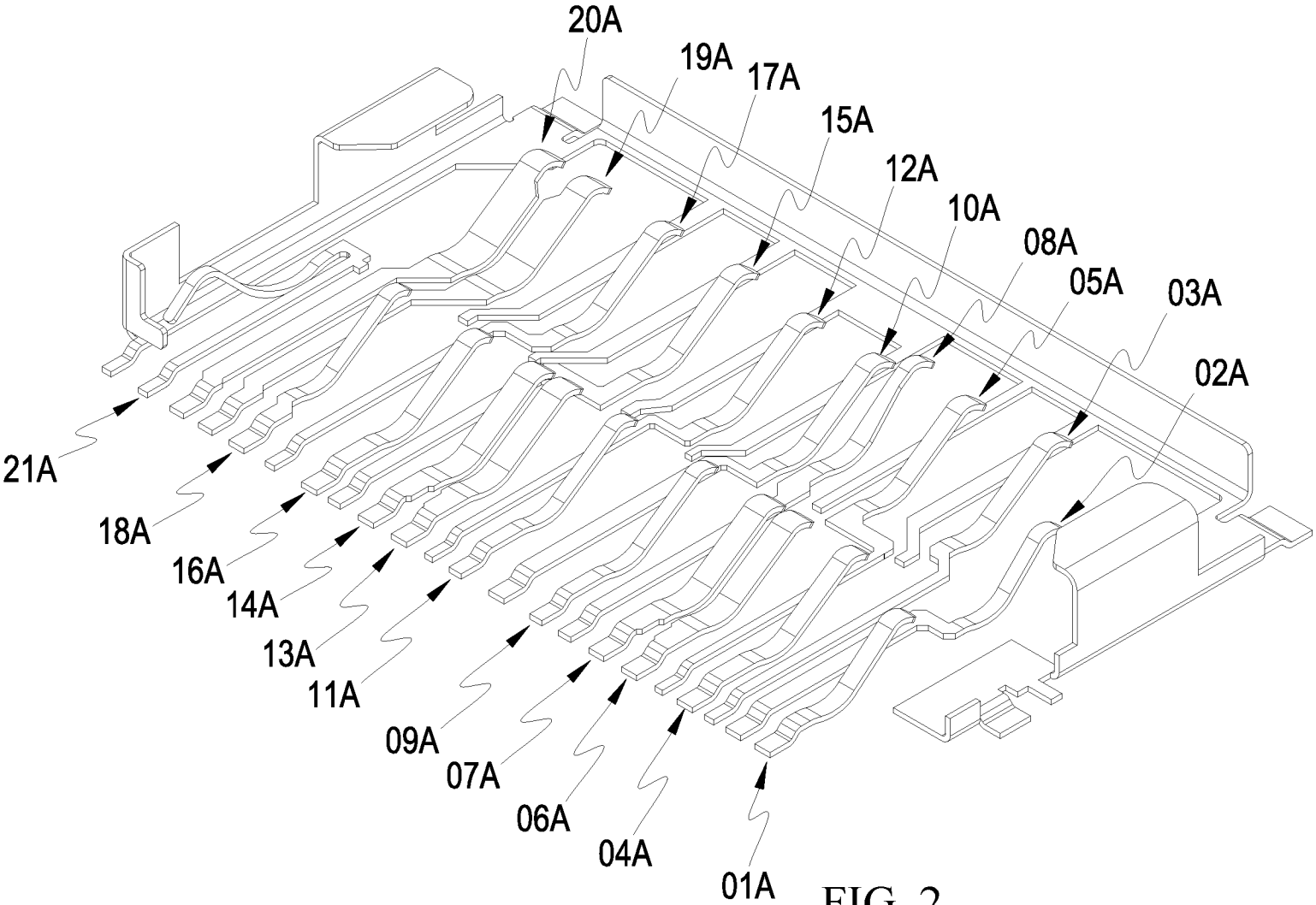
FIG. 2 is a schematic view showing a first conductor group of the present invention.
Figure 3:
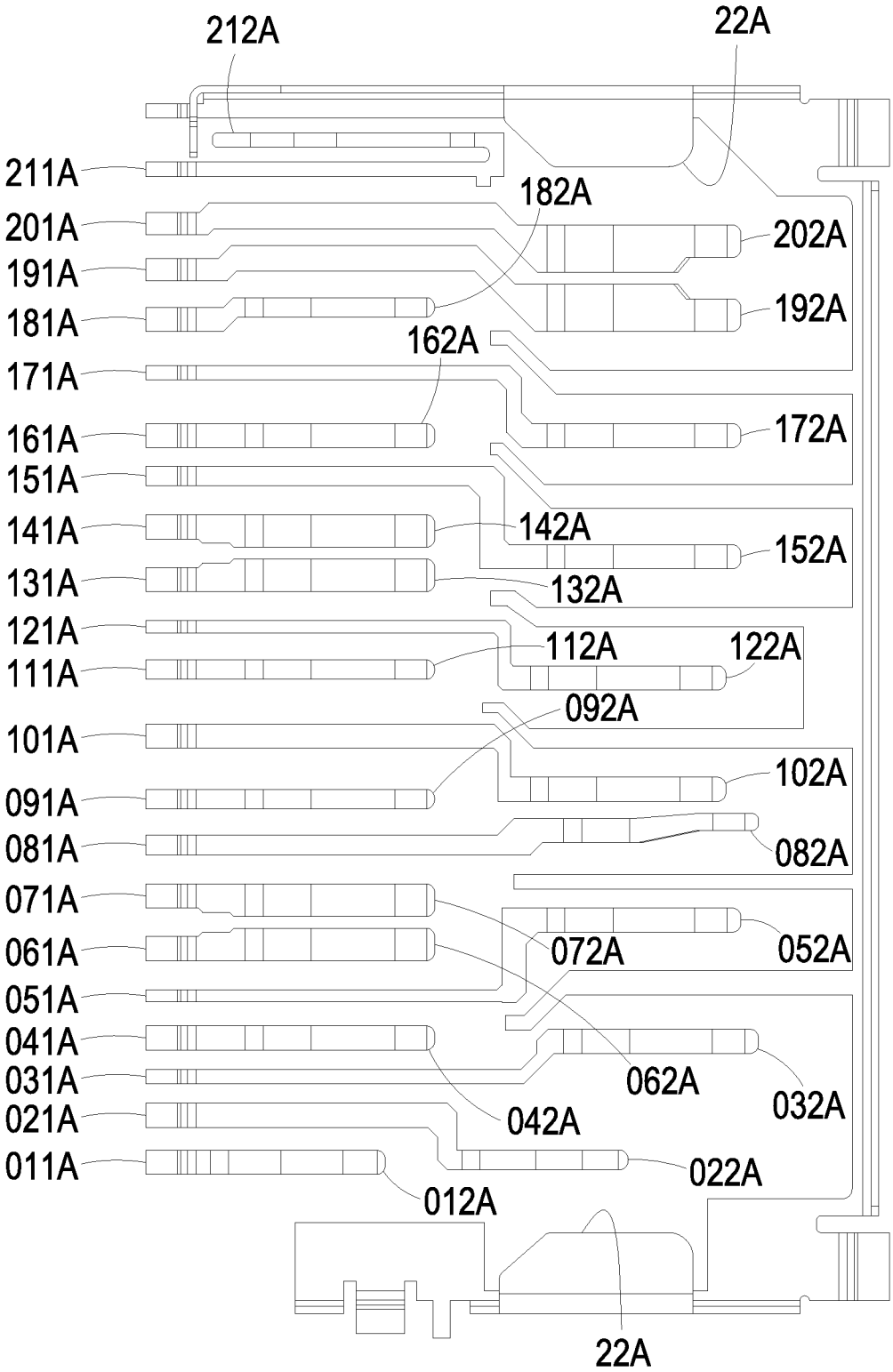
FIG. 3 is another schematic view showing the first conductor group of the present invention.
Figure 4:
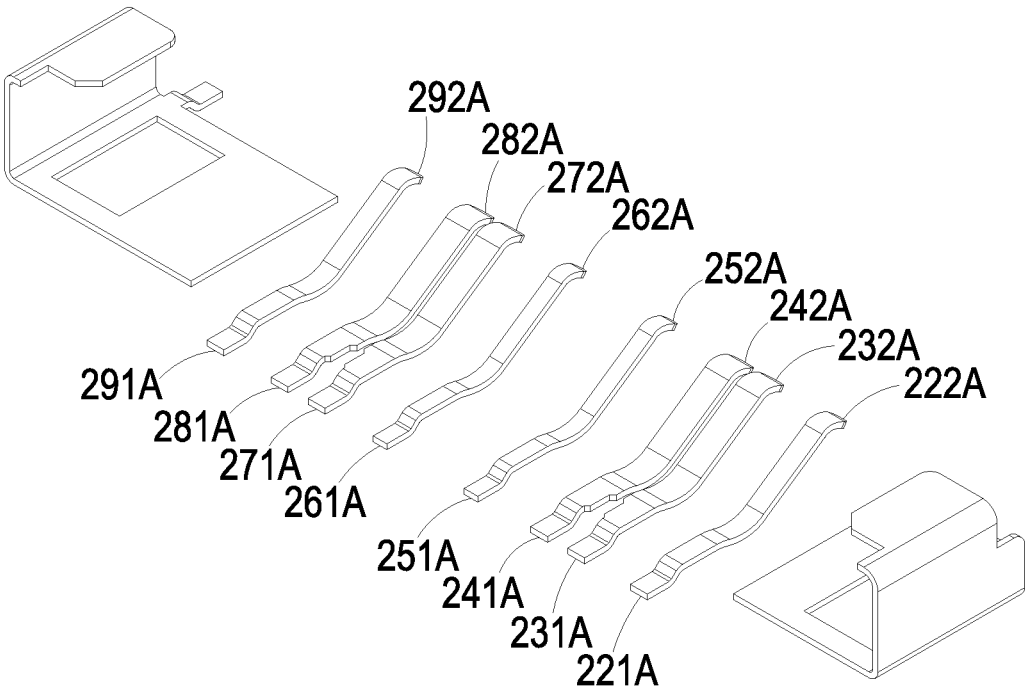
FIG. 4 is a schematic view showing a second conductor group of the present invention.
Figure 5:
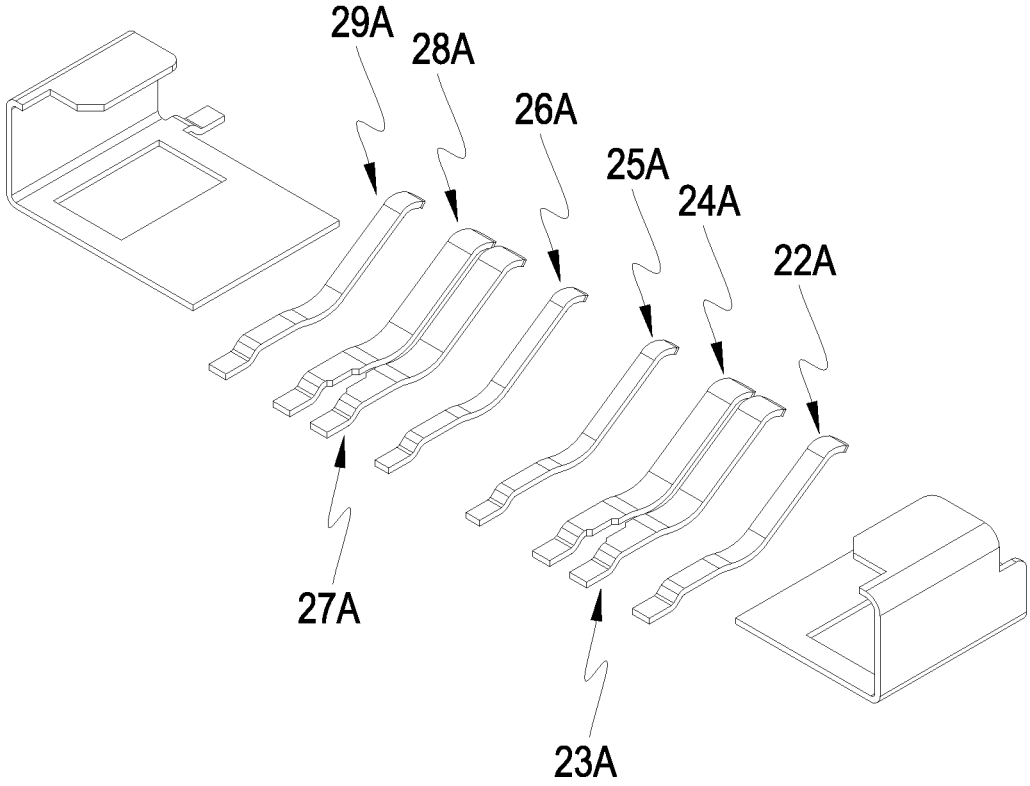
FIG. 5 is another schematic view showing the second conductor group of the present invention.
Figure 6:
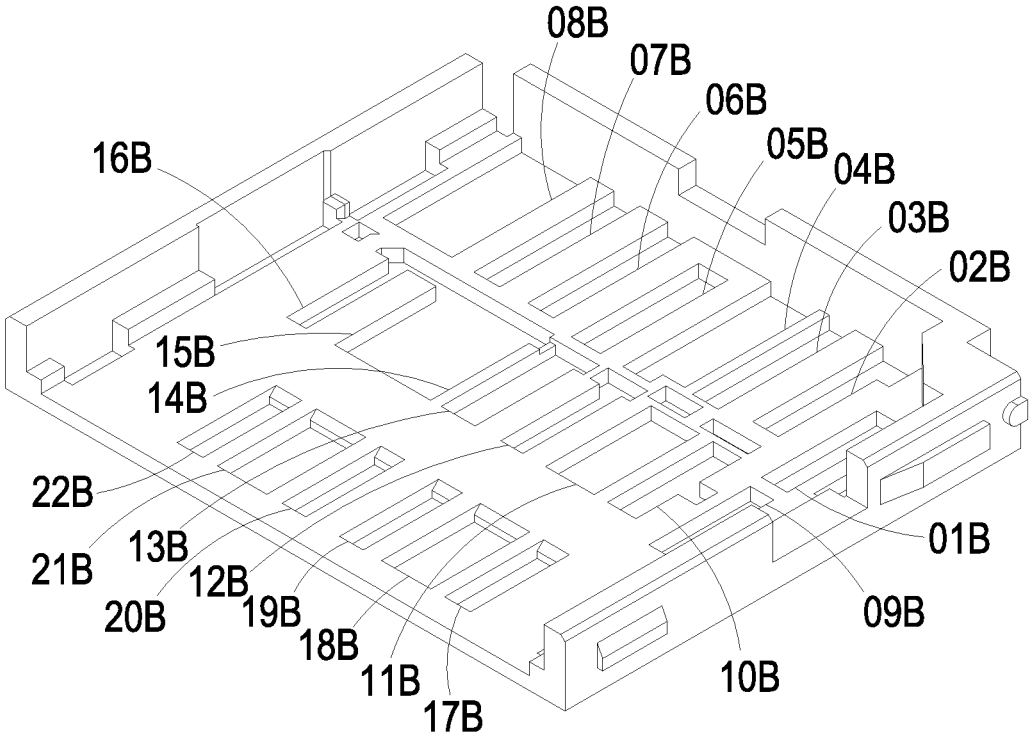
FIG. 6 is a schematic view showing an insulative plastic body of the present invention.
Figure 7:
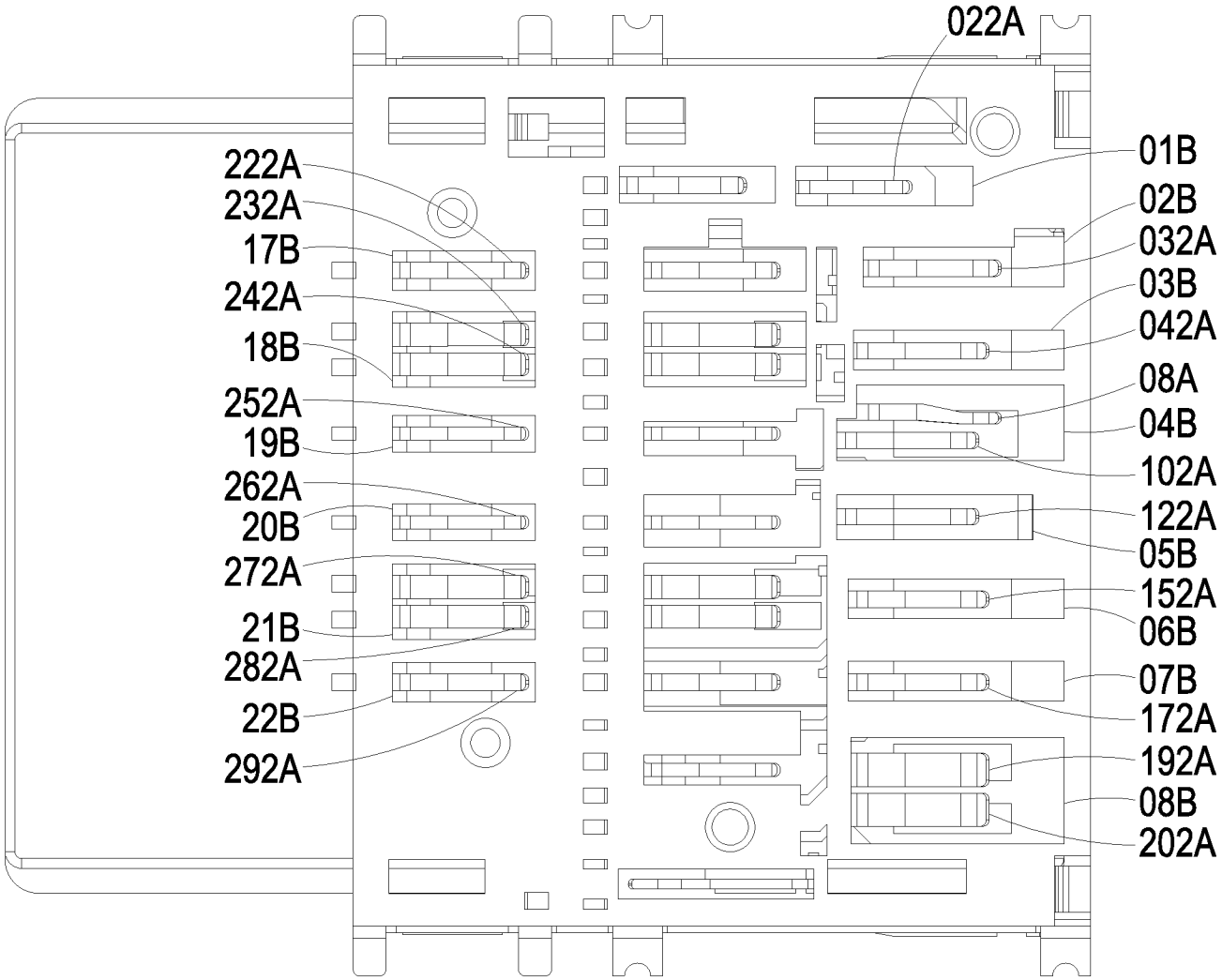
FIG. 7 is a schematic view demonstrating contacting according to the present invention.
Figure 8:
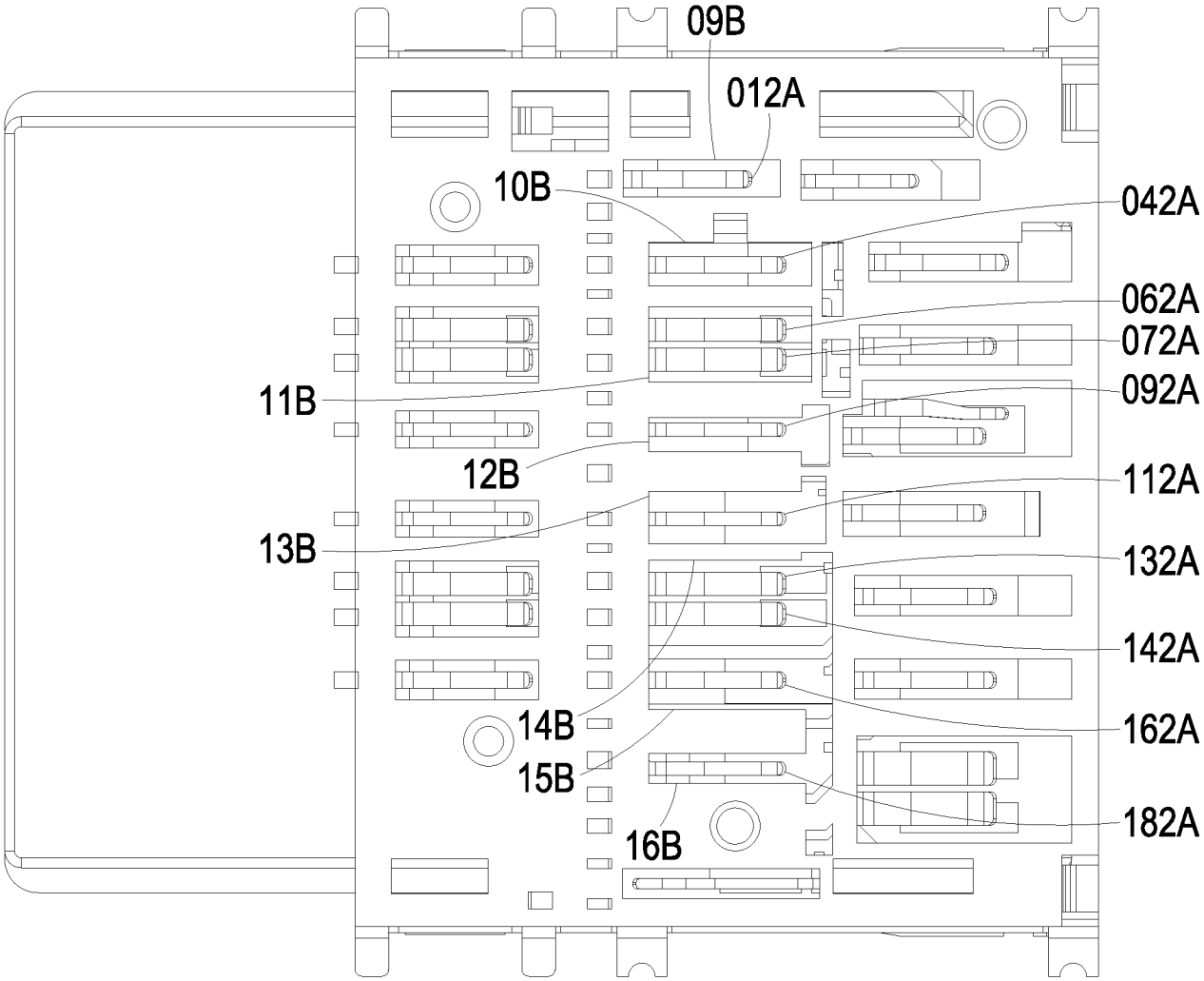
FIG. 8 is another schematic view demonstrating contacting according to the present invention.

Referring to FIGS. 1-8, the drawings clearly show the present invention provides a card connector. The card connector comprises a transmission conductor assembly A, an insulative plastic body B arranged outside the transmission conductor assembly A, and a shielding case C arranged outside the insulative plastic body B. The transmission conductor assembly A comprises a first conductor group 1A and a second conductor group 2A;

wherein the first conductor group 1A comprises:

a backup transmission conductor 01A, wherein the backup transmission conductor 01A has two ends that are extended to respectively form a backup soldering section 011A and a backup spring section 012A;

a first signal transmission conductor 02A, wherein the first signal transmission conductor 02A has two ends that are extended to respectively form a first signal soldering section 021A and a first signal spring section 022A, and the first signal soldering section 021A is located at one side of the backup soldering section 011A;

an inspection signal transmission conductor 03A, wherein the inspection signal transmission conductor 03A has two ends that are extended to respectively form an inspection signal soldering section 031A and an inspection signal spring section 032A, and the inspection signal soldering section 031A is located at one side of the first signal soldering section 021A that is distant from the backup soldering section 011A, the inspection signal spring section 032A is located at one side of the first signal spring section 022A;

a first grounding transmission conductor 04A, wherein the first grounding transmission conductor 04A has two ends that are extended to respectively form a first grounding soldering section 041A and a first grounding spring section 042A, and the first grounding soldering section 041A is located at one side of the inspection signal soldering section 031A that is distant from the first signal soldering section 021A, and the first grounding spring section 042A is located at one side of the backup spring section 012A;

a command reset transmission conductor 05A, wherein the command reset transmission conductor 05A has two ends that are extended to respectively form a command reset soldering section 051A and a command reset spring section 052A, and the command reset soldering section 051A is located at one side of the first grounding soldering section 041A that is distant from the inspection signal soldering section 031A, and the command reset spring section 052A is located at one side of the inspection signal spring section 032A that is distant from the first signal spring section 022A;

a first differential transmission conductor 06A, wherein the first differential transmission conductor 06A has two ends that are extended to respectively form a first differential soldering section 061A and a first differential spring section 062A, and the first differential soldering section 061A is located at one side of the command reset soldering section 051A that is distant from the first grounding soldering section 041A, and the first differential spring section 062A is located at one side of the first grounding spring section 042A;

a second differential transmission conductor 07A, wherein the second differential transmission conductor 07A has two ends that are extended to respectively form a second differential soldering section 071A and a second differential spring section 072A, and the second differential soldering section 071A is located at one side of the first differential soldering section 061A that is distant from the command reset soldering section 051A, and the second differential spring section 072A is located at one side of the first differential spring section 062A that is distant from the first grounding spring section 042A;

a second grounding transmission conductor 08A, wherein the second grounding transmission conductor 08A has two ends that are extended to respectively form a second grounding soldering section 081A and a second grounding spring section 082A, and the second grounding soldering section 081A is located at one side of the second differential soldering section 071A that is distant from the first differential soldering section 061A, and the second grounding spring section 082A is located at one side of the command reset spring section 052A that is distant from the inspection signal spring section 032A;

a third grounding transmission conductor 09A, wherein the third grounding transmission conductor 09A has two ends that are extended to respectively form a third grounding soldering section 091A and a third grounding spring section 092A, and the third grounding soldering section 091A is located at one side of the second grounding soldering section 081A that is distant from the second differential soldering section 071A, and the third grounding spring section 092A is located at one side of the second differential spring section 072A that is distant from the first differential spring section 062A;

a fourth grounding transmission conductor 10A, wherein the fourth grounding transmission conductor 10A has two ends that are extended to respectively form a fourth grounding soldering section 101A and a fourth grounding spring section 102A, and the fourth grounding soldering section 101A is located at one side of the third grounding soldering section 091A that is distant from the second grounding soldering section 081A, and the fourth grounding spring section 102A is located at one side of the second grounding spring section 082A that is distant from the command reset spring section 052A;

a first power transmission conductor 11A, wherein the first power transmission conductor 11A has two ends that are extended to respectively form a first power soldering section 111A and a first power spring section 112A, and the first power soldering section 111A is located at one side of the fourth grounding soldering section 101A that is distant from the third grounding soldering section 091A, and the first power spring section 112A is located at one side of the third grounding spring section 092A that is distant from the second differential spring section 072A;

a second power transmission conductor 12A, wherein the second power transmission conductor 12A has two ends that are extended to respectively form a second power soldering section 121A and a second power spring section 122A, and the second power soldering section 121A is located at one side of the first power soldering section 111A that is distant from the fourth grounding soldering section 101A, and the second power spring section 122A is located at one side of the fourth grounding spring section 102A that is distant from the second grounding spring section 082A;

a third differential transmission conductor 13A, wherein the third differential transmission conductor 13A has two ends that are extended to respectively form a third differential soldering section 131A and a third differential spring section 132A, and the third differential soldering section 131A is located at one side of the second power soldering section 121A that is distant from the first power soldering section 111A, and the third differential spring section 132A is located at one side of the first power spring section 112A that is distant from the third grounding spring section 092A;

a fourth differential transmission conductor 14A, wherein the fourth differential transmission conductor 14A has two ends that are extended to respectively form a fourth differential soldering section 141A and a fourth differential spring section 142A, and the fourth differential soldering section 141A is located at one side of the third differential soldering section 131A that is distant from the second power soldering section 121A, and the fourth differential spring section 142A is located at one side of the third differential spring section 132A that is distant from the first power spring section 112A;

a second signal transmission conductor 15A, wherein the second signal transmission conductor 15A has two ends that are extended to respectively form a second signal soldering section 151A and a second signal spring section 152A, and the second signal soldering section 151A is located at one side of the fourth differential soldering section 141A that is distant from the third differential soldering section 131A, and the second signal spring section 152A is located at one side of the second power spring section 122A that is distant from the fourth grounding spring section 102A;

a fifth grounding transmission conductor 16A, wherein the fifth grounding transmission conductor 16A has two ends that are extended to respectively form a fifth grounding soldering section 161A and a fifth grounding spring section 162A, and the fifth grounding soldering section 161A is located at one side of the second signal soldering section 151A that is distant from the fourth differential soldering section 141A, the fifth grounding spring section 162A is located at one side of the fourth differential spring section 142A that is distant from the third differential spring section 132A;

a sixth grounding transmission conductor 17A, wherein the sixth grounding transmission conductor 17A has two ends that are extended to respectively form a sixth grounding soldering section 171A and a sixth grounding spring section 172A, and the sixth grounding soldering section 171A is located at one side of the fifth grounding soldering section 161A that is distant from the second signal soldering section 151A, and the sixth grounding spring section 172A is located at one side of the second signal spring section 152A that is distant from the second power spring section 122A;

a seventh grounding transmission conductor 18A, wherein the seventh grounding transmission conductor 18A has two ends that are extended to respectively form a seventh grounding soldering section 181A and a seventh grounding spring section 182A, and the seventh grounding soldering section 181A is located at one side of the sixth grounding soldering section 171A that is distant from the fifth grounding soldering section 161A, and the seventh grounding spring section 182A is located at one side of the fifth grounding spring section 162A that is distant from the fourth differential spring section 142A;

a fifth differential transmission conductor 19A, wherein the fifth differential transmission conductor 19A has two ends that are extended to respectively form a fifth differential soldering section 191A and a fifth differential spring section 192A, and the fifth differential soldering section 191A is located at one side of the seventh grounding soldering section 181A that is distant from the sixth grounding soldering section 171A, and the fifth differential spring section 192A is located at one side of the sixth grounding spring section 172A that is distant from the second signal spring section 152A;

a sixth differential transmission conductor 20A, wherein the sixth differential transmission conductor 20A has two ends that are extended to respectively form a sixth differential soldering section 201A and a sixth differential spring section 202A, and the sixth differential soldering section 201A is located at one side of the fifth differential soldering section 191A that is distant from the seventh grounding soldering section 181A, and the sixth differential spring section 202A is located at one side of the fifth differential spring section 192A that is distant from the sixth grounding spring section 172A; and a write-protection transmission conductor 21A, wherein the write-protection transmission conductor 21A has two ends that are extended to respectively form a write-protection grounding soldering section 211A and a write-protection spring section 212A, and the write-protection grounding soldering section 211A is located at one side of the sixth differential soldering section 201A that is distant from the fifth differential soldering section 191A, and the write-protection spring section 212A is located at one side of the seventh grounding spring section 182A that is distant from the fifth grounding spring section 162A; and the second conductor group 2A comprises:

an eighth grounding transmission conductor 22A, wherein the eighth grounding transmission conductor 22A has two ends that are extended to respectively form an eighth grounding soldering section 221A and an eighth grounding spring section 222A;

a seventh differential transmission conductor 23A, wherein the seventh differential transmission conductor 23A has two ends that are extended to respectively form a seventh differential soldering section 231A and a seventh differential spring section 232A, and the seventh differential soldering section 231A is located at one side of the eighth grounding soldering section 221A, and the seventh differential spring section 232A is located at one side of the eighth grounding spring section 222A;

an eighth differential transmission conductor 24A, wherein the eighth differential transmission conductor 24A has two ends that are extended to respectively form an eighth differential soldering section 241A and an eighth differential spring section 242A, and the eighth differential soldering section 241A is located at one side of the seventh differential soldering section 231A that is distant from the eighth grounding soldering section 221A, and the eighth differential spring section 242A is located at one side of the seventh differential spring section 232A that is distant from the eighth grounding spring section 222A;

a ninth grounding transmission conductor 25A, wherein the ninth grounding transmission conductor 25A has two ends that are extended to respectively form a ninth grounding soldering section 251A and a ninth grounding spring section 252A, and the ninth grounding soldering section 251A is located at one side of the eighth differential soldering section 241A that is distant from the seventh differential soldering section 231A, and the ninth grounding spring section 252A is located at one side of the eighth differential spring section 242A that is distant from the seventh differential spring section 232A;

a third power transmission conductor 26A, wherein the third power transmission conductor 26A has two ends that are extended to respectively form a third power soldering section 261A and a third power spring section 262A, and the third power soldering section 261A is located at one side of the ninth grounding soldering section 251A that is distant from the eighth differential soldering section 241A, and the third power spring section 262A is located at one side of the ninth grounding spring section 252A that is distant from the eighth differential spring section 242A;

a ninth differential transmission conductor 27A, wherein the ninth differential transmission conductor 27A has two ends that are extended to respectively form a ninth differential soldering section 271A and a ninth differential spring section 272A, and the ninth differential soldering section 271A is located at one side of the third power soldering section 261A that is distant from the ninth grounding soldering section 251A, and the ninth differential spring section 272A is located at one side of the third power spring section 262A that is distant from the ninth grounding spring section 252A;

a tenth differential transmission conductor 28A, wherein the tenth differential transmission conductor 28A has two ends that are extended to respectively form a tenth differential soldering section 281A and a tenth differential spring section 282A, and the tenth differential soldering section 281A is located at one side of the ninth differential soldering section 271A that is distant from the third power soldering section 261A, and the tenth differential spring section 282A is located at one side of the ninth differential spring section 272A that is distant from the third power spring section 262A; and a tenth grounding transmission conductor 29A, wherein the tenth grounding transmission conductor 29A has two ends that are extended to respectively form a tenth grounding soldering section 291A and a tenth grounding spring section 292A, and the tenth grounding soldering section 291A is located at one side of the tenth differential soldering section 281A that is distant from the ninth differential soldering section 271A, and the tenth grounding spring section 292A is located at one side of the tenth differential spring section 282A that is distant from the ninth differential spring section 272A.

Further, the insulative plastic body B is provided with a first signal constraining section 01B, an inspection signal constraining section 02B located at one side of the first signal constraining section 01B, a command reset constraining section 03B located at one side of the inspection signal constraining section 02B that is distant from the first signal constraining section 01B, a second grounding constraining section 04B located at one side of the command reset constraining section 03B that is distant from the inspection signal constraining section 02B, a second power constraining section 05B located at one side of the second grounding constraining section 04B that is distant from the command reset constraining section 03B, a second signal constraining section 06B located at one side of the second power constraining section 05B that is distant from the second grounding constraining section 04B, a sixth grounding constraining section 07B located at one side of the second signal constraining section 06B that is distant from the second power constraining section 05B, a first differential group constraining section 08B located at one side of the sixth grounding constraining section 07B that is distant from the second signal constraining section 06B, a backup constraining section 09B located at one side of the first signal constraining section 01B, a first grounding constraining section 10B located at one side of the backup constraining section 09B, a second differential group constraining section 11B located at one side of the first grounding constraining section 10B, a third grounding constraining section 12B located at one side of the second differential group constraining section 11B that is distant from the first grounding constraining section 10B, a first power constraining section 13B located at one side of the third grounding constraining section 12B that is distant from the second differential group constraining section 11B, a third differential group constraining section 14B located at one side of the first power constraining section 13B that is distant from the third grounding constraining section 12B, a fifth grounding constraining section 15B located at one side of the third differential group constraining section 14B that is distant from the first power constraining section 13B, and a seventh grounding constraining section 16B located at one side of the fifth grounding constraining section 15B that is distant from the third differential group constraining section 14B; and an eighth grounding constraining section 17B located at one side of the first grounding constraining section 10B, a fourth differential group constraining section 18B located at one side of the eighth grounding constraining section 17B, a ninth grounding constraining section 19B located at one side of the fourth differential group constraining section 18B that is distant from the eighth grounding constraining section 17B, a third power constraining section 20B located at one side of the ninth grounding constraining section 19B that is distant from the fourth differential group constraining section 18B, a fifth differential group constraining section 21B located at one side of the third power constraining section 20B that is distant from the ninth grounding constraining section 19B, and a tenth grounding constraining section 22B located at one side of the fifth differential group constraining section 21B that is distant from the third power constraining section 20B.

The above description provides an understanding to the structure of the present invention, and based on a combination of such a structure, advantages of bettered high frequency performance, reduced capacitive effect, and suppressed electromagnetic radiation interference may be realized. Details for explanation are provided below.

A users may insert an SC card into the shielding case C. The SC card, upon insertion into the shielding case C, is enabled to detect whether the SC card de-activates the function of write protection by means of the write-protection spring section 212A getting into engagement with the SC card. The SC card is brought into contact engagement with the transmission conductor assembly A, and for the first conductor group 1A, the first signal spring section 022A is received into and constrained in the first signal constraining section 01B; the inspection signal spring section 032A is received into and constrained in the inspection signal constraining section 02B; the command reset spring section 052A is received into and constrained in the command reset constraining section 03B; the second grounding spring section 082A is received into and constrained in the second grounding constraining section 04B; the second power spring section 122A is received into and constrained in the second power constraining section 05B; the second signal spring section 152A is received into and constrained in the second signal constraining section 06B; the sixth grounding spring section 172A is received into and constrained in the sixth grounding constraining section 07B; the fifth differential spring section 192A and the sixth differential spring section 202A are received into and constrained in the first differential group constraining section 08B; the backup spring section 012A is received into and constrained in the backup constraining section 09B; the first grounding spring section 042A is received into and constrained in the first grounding constraining section 10B; the first differential spring section 062A and the second differential spring section 072A are received into and constrained in the second differential group constraining section 11B; the third grounding spring section 092A is received into and constrained in the third grounding constraining section 12B, the first power spring section 112A is received into and constrained in the first power constraining section 13B; the third differential spring section 132A and the fourth differential spring section 142A are received into and constrained in the third differential group constraining section 14B; the fifth grounding spring section 162A is received into and constrained in the fifth grounding constraining section 15B, and the seventh grounding spring section 182A is received into and constrained in the seventh grounding constraining section 16B; and for the second conductor group 2A, the eighth grounding spring section 222A is received into and constrained in the eighth grounding constraining section 17B; the seventh differential spring section 232A and the eighth differential spring section 242A are received into and constrained in the fourth differential group constraining section 18B; the ninth grounding spring section 252A is received into and constrained in the ninth grounding constraining section 19B; the third power spring section 262A is received into and constrained in the third power constraining section 20B; the ninth differential spring section 272A and the tenth differential spring section 282A are received into and constrained in the fifth differential group constraining section 21B; and the tenth grounding spring section 292A is received into and constrained in the tenth grounding constraining section 22B.

Further, contact points of the SC card are set in contact engagement with the backup spring section 012A, the first signal spring section 022A, the inspection signal spring section 032A, the first grounding spring section 042A, the command reset spring section 052A, the first differential spring section 062A, the second differential spring section 072A, the second grounding spring section 082A, the third grounding spring section 092A, the fourth grounding spring section 102A, the first power spring section 112A, the second power spring section 122A, the third differential spring section 132A, the fourth differential spring section 142A, the second signal spring section 152A, the fifth grounding spring section 162A, the sixth grounding spring section 172A, the seventh grounding spring section 182A, the fifth differential spring section 192A, the sixth differential spring section 202A, the eighth grounding spring section 222A, the seventh differential spring section 232A, the eighth differential spring section 242A, the ninth grounding spring section 252A, the third power spring section 262A, the ninth differential spring section 272A, the tenth differential spring section 282A, and the tenth grounding spring section 292A of the transmission conductor assembly A, in order to establish connection between the SC card and the first conductor group 1A and the second conductor group 2A of the transmission conductor assembly A. During transmission of signals, due to the first differential soldering section 061A and the second differential soldering section 071A, the third differential soldering section 131A and the fourth differential soldering section 141A, the fifth differential soldering section 191A and the sixth differential soldering section 201A, the seventh differential soldering section 231A and the eighth differential soldering section 241A, the ninth differential soldering section 271A and the tenth differential soldering section 281A being respectively arranged side by side in a pairwise form, and the first differential soldering section 061A and the second differential soldering section 071A being provided, on two opposite sides thereof, with the first grounding soldering section 041A and the third grounding soldering section 091A, and the third differential soldering section 131A and the fourth differential soldering section 141A being provided, on two opposite sides thereof, with the fourth grounding soldering section 101A and the fifth grounding soldering section 161A, and the fifth differential soldering section 191A and the sixth differential soldering section 201A being provided, on two opposite sides thereof, with the seventh grounding soldering section 181A and the write-protection grounding soldering section 211A, and the seventh differential soldering section 231A and the eighth differential soldering section 241A being provided, on two opposite sides thereof, with the eighth grounding soldering section 221A and the ninth grounding soldering section 251A, and the ninth differential soldering section 271A and the tenth differential soldering section 281A being provided, on two opposite sides thereof, with the ninth grounding soldering section 251A and the tenth grounding soldering section 291A, each differential group is provided, on two opposite sides thereof, with grounding sections, such that, by means of the above-described arrangement, advantages of bettering high frequency performance, reducing capacitive effect, and suppressing electromagnetic radiation interference can be realized.

Figure 9:
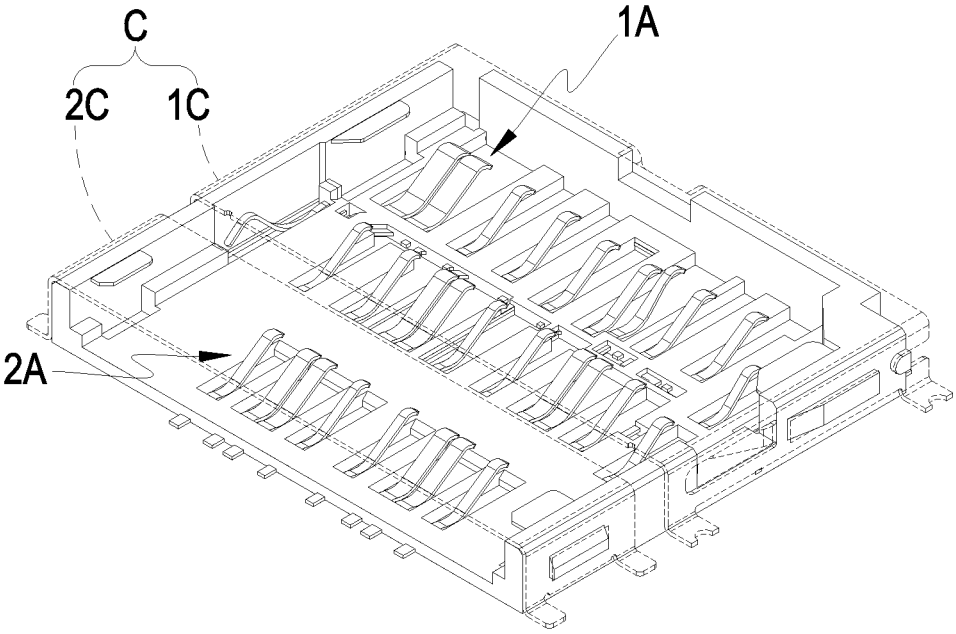
FIG. 9 is a perspective view showing another embodiment of the present invention.

Further referring to FIG. 9, the drawing clearly shows that the instant embodiment is generally similar to the previous embodiment and that in the instant embodiment, the shielding case C comprises a first shielding case 1C and a second shielding case 2C, wherein the first shielding case 1C is arranged outside the first conductor group 1A, and the second shielding case 2C is arranged outside the second conductor group 2A. This is provided to illustrate that the configuration of the shielding case C is not limitative.

Figure 10:
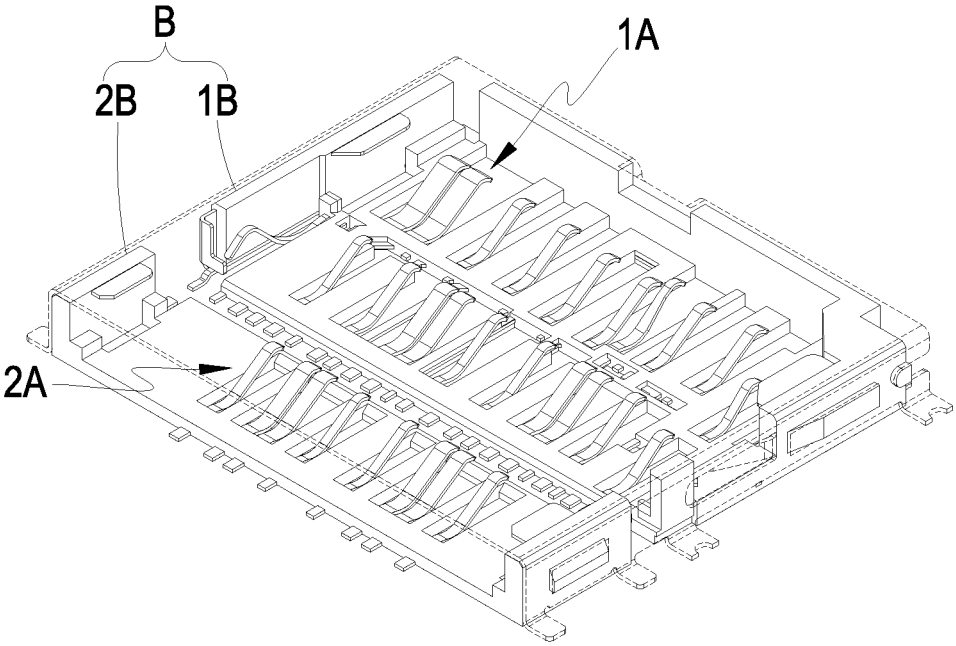
FIG. 10 is a perspective view showing a further embodiment of the present invention.
Figure 11:
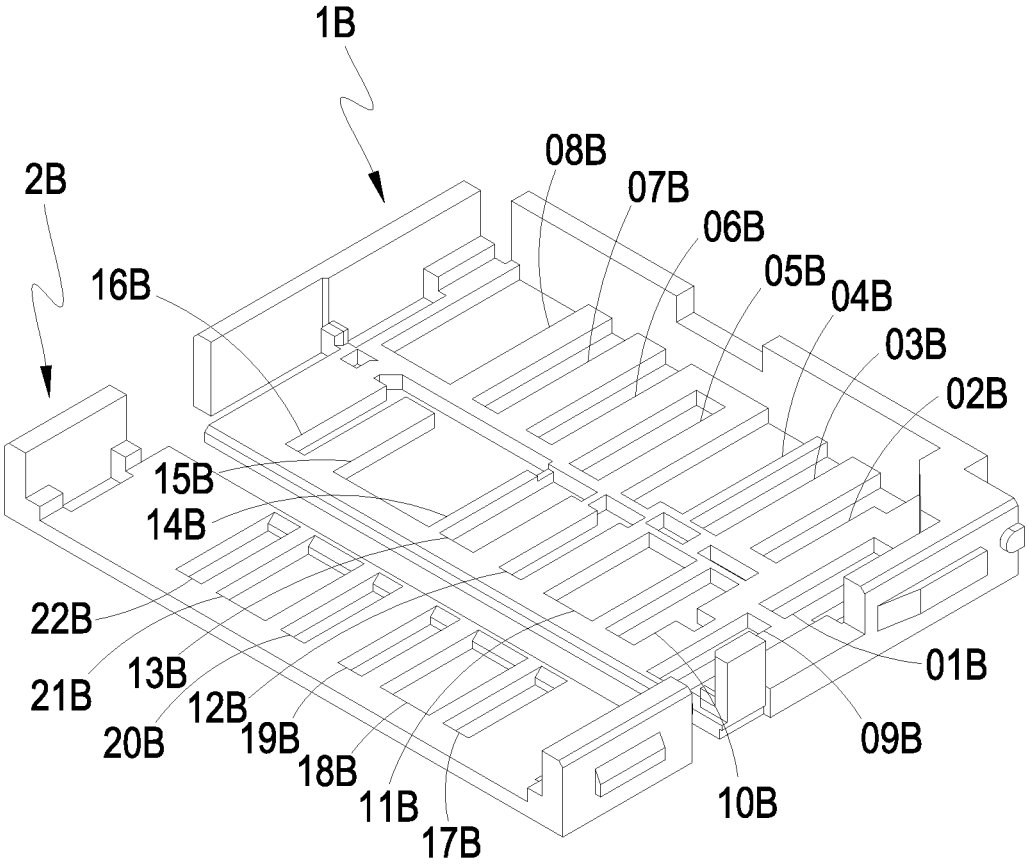
FIG. 11 is a schematic view showing an insulative plastic bod according to said further embodiment and yet a further embodiment of the present invention.

Further referring to FIGS. 10 and 11, the drawings clearly show that the instant embodiment is generally similar to the previous embodiments and that in the instant embodiment, the insulative plastic body B comprises a first insulative plastic body 1B and a second insulative plastic body 2B, wherein the first insulative plastic body 1B is arranged outside the first conductor group 1A, and the second insulative plastic body 2B is arranged outside the second conductor group 2A, wherein the first signal constraining section 01B, the inspection signal constraining section 02B, the command reset constraining section 03B, the second grounding constraining section 04B, the second power constraining section 05B, the second signal constraining section 06B, the sixth grounding constraining section 07B, the first differential group constraining section 08B, the backup constraining section 09B, the first grounding constraining section 10B, the second differential group constraining section 11B, the third grounding constraining section 12B, the first power constraining section 13B, the third differential group constraining section 14B, the fifth grounding constraining section 15B, and the seventh grounding constraining section 16B are arranged on one side of the first insulative plastic body 1B, and the eighth grounding constraining section 17B, the fourth differential group constraining section 18B, the ninth grounding constraining section 19B, the third power constraining section 20B, the fifth differential group constraining section 21B, and the tenth grounding constraining section 22B are arranged on one side of the second insulative plastic body 2B. This is provided to illustrate that the configuration of the insulative plastic body B is not limitative.

Figure 12:
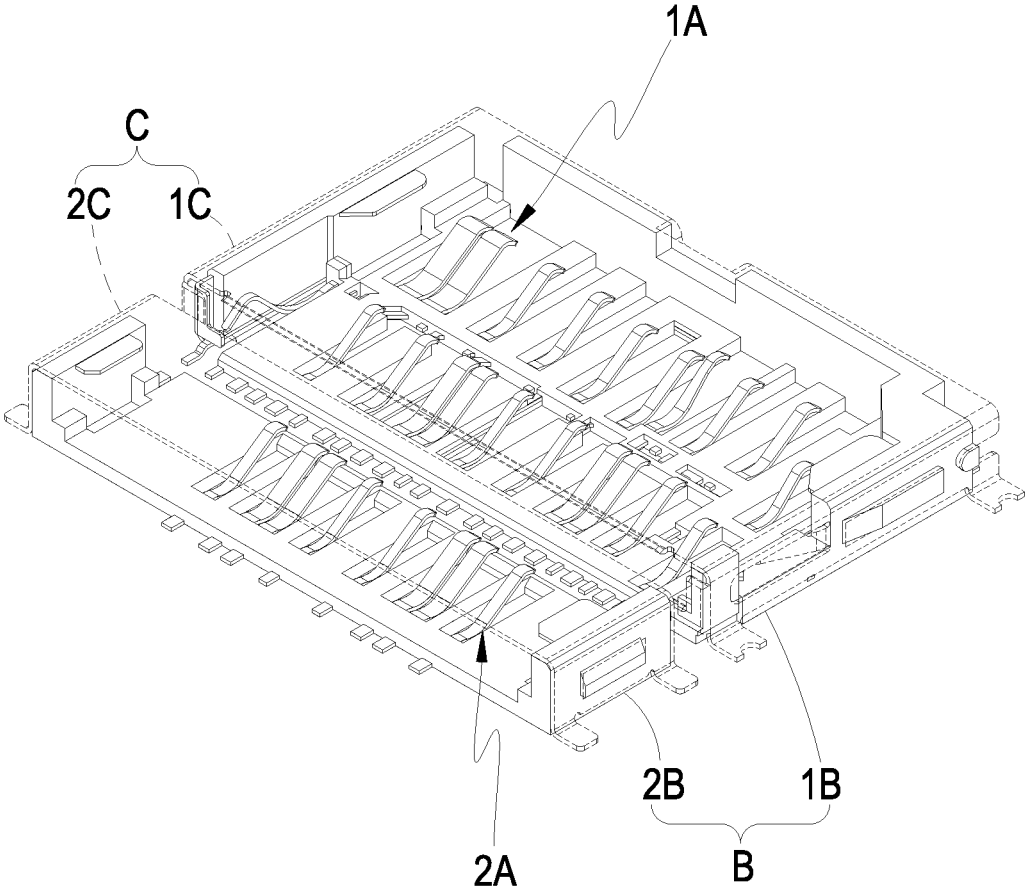
FIG. 12 is a perspective view showing said yet a further embodiment of the present invention.

Further referring to FIGS. 11 and 12, which are a schematic view and a perspective view of yet a further embodiment of the present invention, the drawings clearly show that the instant embodiment is generally similar to the previous embodiments and that in the instant embodiment, the insulative plastic body B comprises a first insulative plastic body 1B and a second insulative plastic body 2B, and the first insulative plastic body 1B is arranged outside the first conductor group 1A, and the second insulative plastic body 2B is arranged outside the second conductor group 2A, and the shielding case C comprises a first shielding case 1C arranged outside the first insulative plastic body 1B and a second shielding case 2C arranged outside the second insulative plastic body 2B, wherein the first signal constraining section 01B, the inspection signal constraining section 02B, the command reset constraining section 03B, the second grounding constraining section 04B, the second power constraining section 05B, the second signal constraining section 06B, the sixth grounding constraining section 07B, the first differential group constraining section 08B, the backup constraining section 09B, the first grounding constraining section 10B, the second differential group constraining section 11B, the third grounding constraining section 12B, the first power constraining section 13B, the third differential group constraining section 14B, the fifth grounding constraining section 15B, and the seventh grounding constraining section 16B are arranged on one side of the first insulative plastic body 1B, and the eighth grounding constraining section 17B, the fourth differential group constraining section 18B, the ninth grounding constraining section 19B, the third power constraining section 20B, the fifth differential group constraining section 21B, and the tenth grounding constraining section 22B are arranged on one side of the second insulative plastic body 2B. This is provided to illustrate that the configurations of the insulative plastic body B and the shielding case C are not limitative.

We claim:

1. A card connector, the card connector comprising a transmission conductor assembly, wherein the transmission conductor assembly mainly comprises:

a first conductor group and a second conductor group arranged at one side of the first conductor group, wherein the first conductor group comprises:

a backup transmission conductor, wherein the backup transmission conductor has an end extended to form a backup soldering section;

a first signal transmission conductor, wherein the first signal transmission conductor has an end extended to form a first signal soldering section, and the first signal soldering section is located at one side of the backup soldering section;

an inspection signal transmission conductor, wherein the inspection signal transmission conductor has an end extended to form an inspection signal soldering section, and the inspection signal soldering section is located at one side of the first signal soldering section that is distant from the backup soldering section;

a first grounding transmission conductor, wherein the first grounding transmission conductor has an end extended to form a first grounding soldering section, and the first grounding soldering section is located at one side of the inspection signal soldering section that is distant from the first signal soldering section;

a command reset transmission conductor, wherein the command reset transmission conductor has an end extended to form a command reset soldering section, and the command reset soldering section is located at one side of the first grounding soldering section that is distant from the inspection signal soldering section;

a first differential transmission conductor, wherein the first differential transmission conductor has an end extended to form a first differential soldering section, and the first differential soldering section is located at one side of the command reset soldering section that is distant from the first grounding soldering section;

a second differential transmission conductor, wherein the second differential transmission conductor has an end extended to form a second differential soldering section, and the second differential soldering section is located at one side of the first differential soldering section that is distant from the command reset soldering section;

a second grounding transmission conductor, wherein the second grounding transmission conductor has an end extended to form a second grounding soldering section, and the second grounding soldering section is located at one side of the second differential soldering section that is distant from the first differential soldering section;

a third grounding transmission conductor, wherein the third grounding transmission conductor has an end extended to form a third grounding soldering section, and the third grounding soldering section is located at one side of the second grounding soldering section that is distant from the second differential soldering section;

a fourth grounding transmission conductor, wherein the fourth grounding transmission conductor has an end extended to form a fourth grounding soldering section, and the fourth grounding soldering section is located at one side of the third grounding soldering section that is distant from the second grounding soldering section;

a first power transmission conductor, wherein the first power transmission conductor has an end extended to form a first power soldering section, and the first power soldering section is located at one side of the fourth grounding soldering section that is distant from the third grounding soldering section;

a second power transmission conductor, wherein the second power transmission conductor has an end extended to form a second power soldering section, and the second power soldering section is located at one side of the first power soldering section that is distant from the fourth grounding soldering section;

a third differential transmission conductor, wherein the third differential transmission conductor has an end extended to form a third differential soldering section, and the third differential soldering section is located at one side of the second power soldering section that is distant from the first power soldering section;

a fourth differential transmission conductor, wherein the fourth differential transmission conductor has an end extended to form a fourth differential soldering section, and the fourth differential soldering section is located at one side of the third differential soldering section that is distant from the second power soldering section;

a second signal transmission conductor, wherein the second signal transmission conductor has an end extended to form a second signal soldering section, and the second signal soldering section is located at one side of the fourth differential soldering section that is distant from the third differential soldering section;

a fifth grounding transmission conductor, wherein the fifth grounding transmission conductor has an end extended to form a fifth grounding soldering section, and the fifth grounding soldering section is located at one side of the second signal soldering section that is distant from the fourth differential soldering section;

a sixth grounding transmission conductor, wherein the sixth grounding transmission conductor has an end extended to form a sixth grounding soldering section, and the sixth grounding soldering section is located at one side of the fifth grounding soldering section that is distant from the second signal soldering section;

a seventh grounding transmission conductor, wherein the seventh grounding transmission conductor has an end extended to form a seventh grounding soldering section, and the seventh grounding soldering section is located at one side of the sixth grounding soldering section that is distant from the fifth grounding soldering section;

a fifth differential transmission conductor, wherein the fifth differential transmission conductor has an end extended to form a fifth differential soldering section, and the fifth differential soldering section is located at one side of the seventh grounding soldering section that is distant from the sixth grounding soldering section;

a sixth differential transmission conductor, wherein the sixth differential transmission conductor has an end extended to form a sixth differential soldering section, and the sixth differential soldering section is located at one side of the fifth differential soldering section that is distant from the seventh grounding soldering section; and a write-protection transmission conductor, wherein the write-protection transmission conductor has an end extended to form a write-protection grounding soldering section, and the write-protection grounding soldering section is located at one side of the sixth differential soldering section that is distant from the fifth differential soldering section; and the second conductor group comprises:

an eighth grounding transmission conductor, wherein the eighth grounding transmission conductor has an end extended to form an eighth grounding soldering section;

a seventh differential transmission conductor, wherein the seventh differential transmission conductor has an end extended to form a seventh differential soldering section, and the seventh differential soldering section is located at one side of the eighth grounding soldering section;

an eighth differential transmission conductor, wherein the eighth differential transmission conductor has an end extended to form an eighth differential soldering section, and the eighth differential soldering section is located at one side of the seventh differential soldering section that is distant from the eighth grounding soldering section;

a ninth grounding transmission conductor, wherein the ninth grounding transmission conductor has an end extended to form a ninth grounding soldering section, and the ninth grounding soldering section is located at one side of the eighth differential soldering section that is distant from the seventh differential soldering section;

a third power transmission conductor, wherein the third power transmission conductor has an end extended to form a third power soldering section, and the third power soldering section is located at one side of the ninth grounding soldering section that is distant from the eighth differential soldering section;

a ninth differential transmission conductor, wherein the ninth differential transmission conductor has an end extended to form a ninth differential soldering section, and the ninth differential soldering section is located at one side of the third power soldering section that is distant from the ninth grounding soldering section;

a tenth differential transmission conductor, wherein the tenth differential transmission conductor has an end extended to form a tenth differential soldering section, and the tenth differential soldering section is located at one side of the ninth differential soldering section that is distant from the third power soldering section; and a tenth grounding transmission conductor, wherein the tenth grounding transmission conductor has an end extended to form a tenth grounding soldering section, and the tenth grounding soldering section is located at one side of the tenth differential soldering section that is distant from the ninth differential soldering section.

2. The card connector according to claim 1, wherein an insulative plastic body is arranged outside the transmission conductor assembly, and a shielding case is arranged outside the insulative plastic body, wherein the insulative plastic body is provided with a first signal constraining section, an inspection signal constraining section located at one side of the first signal constraining section, a command reset constraining section located at one side of the inspection signal constraining section that is distant from the first signal constraining section, a second grounding constraining section located at one side of the command reset constraining section that is distant from the inspection signal constraining section, a second power constraining section located at one side of the second grounding constraining section that is distant from the command reset constraining section, a second signal constraining section located at one side of the second power constraining section that is distant from the second grounding constraining section, a sixth grounding constraining section located at one side of the second signal constraining section that is distant from the second power constraining section, a first differential group constraining section located at one side of the sixth grounding constraining section that is distant from the second signal constraining section, a backup constraining section located at one side of the first signal constraining section, a first grounding constraining section located at one side of the backup constraining section, a second differential group constraining section located at one side of the first grounding constraining section, a third grounding constraining section located at one side of the second differential group constraining section that is distant from the first grounding constraining section, a first power constraining section located at one side of the third grounding constraining section that is distant from the second differential group constraining section, a third differential group constraining section located at one side of the first power constraining section that is distant from the third grounding constraining section, a fifth grounding constraining section located at one side of the third differential group constraining section that is distant from the first power constraining section, a seventh grounding constraining section located at one side of the first grounding constraining section that is distant from the third differential group constraining section, an eighth grounding constraining section located at one side of the first grounding constraining section, a fourth differential group constraining section located at one side of the eighth grounding constraining section, a ninth grounding constraining section located at one side of the fourth differential group constraining section that is distant from the eighth grounding constraining section, a third power constraining section located at one side of the ninth grounding constraining section that is distant from the fourth differential group constraining section, a fifth differential group constraining section located at one side of the third power constraining section that is distant from the ninth grounding constraining section, and a tenth grounding constraining section located at one side of the fifth differential group constraining section that is distant from the third power constraining section.

3. The card connector according to claim 1, wherein an insulative plastic body is arranged outside the transmission conductor assembly, and a shielding case is arranged outside the insulative plastic body, wherein the insulative plastic body comprises a first insulative plastic body arranged outside the first conductor group, and a second insulative plastic body arranged outside the second conductor group, and the shielding case comprises a first shielding case arranged outside the first insulative plastic body, and a second shielding case arranged outside the second insulative plastic body, wherein the first insulative plastic body is provided with a first signal constraining section, an inspection signal constraining section located at one side of the first signal constraining section, a command reset constraining section located at one side of the inspection signal constraining section that is distant from the first signal constraining section, a second grounding constraining section located at one side of the command reset constraining section that is distant from the inspection signal constraining section, a second power constraining section located at one side of the second grounding constraining section that is distant from the command reset constraining section, a second signal constraining section located at one side of the second power constraining section that is distant from the second grounding constraining section, a sixth grounding constraining section located at one side of the second signal constraining section that is distant from the second power constraining section, a first differential group constraining section located at one side of the sixth grounding constraining section that is distant from the second signal constraining section, a backup constraining section located at one side of the first signal constraining section, a first grounding constraining section located at one side of the backup constraining section, a second differential group constraining section located at one side of the first grounding constraining section, a third grounding constraining section located at one side of the second differential group constraining section that is distant from the first grounding constraining section, a first power constraining section located at one side of the third grounding constraining section that is distant from the second differential group constraining section, a third differential group constraining section located at one side of the first power constraining section that is distant from the third grounding constraining section, a fifth grounding constraining section located at one side of the third differential group constraining section that is distant from the first power constraining section, and a seventh grounding constraining section located at one side of the fifth grounding constraining section that is distant from the third differential group constraining section; and the second insulative plastic body is provided with an eighth grounding constraining section, a fourth differential group constraining section located at one side of the eighth grounding constraining section, a ninth grounding constraining section located at one side of the fourth differential group constraining section that is distant from the eighth grounding constraining section, a third power constraining section located at one side of the ninth grounding constraining section that is distant from the fourth differential group constraining section, a fifth differential group constraining section located at one side of the third power constraining section that is distant from the ninth grounding constraining section, and a tenth grounding constraining section located at one side of the fifth differential group constraining section that is distant from the third power constraining section.

4. The card connector according to claim 1, wherein an insulative plastic body is arranged outside the transmission conductor assembly, and a shielding case is arranged outside the insulative plastic body, wherein the shielding case comprises a first shielding case arranged outside the first conductor group, and a second shielding case arranged outside the second conductor group, wherein the insulative plastic body is provided with a first signal constraining section, an inspection signal constraining section located at one side of the first signal constraining section, a command reset constraining section located at one side of the inspection signal constraining section that is distant from the first signal constraining section, a second grounding constraining section located at one side of the command reset constraining section that is distant from the inspection signal constraining section, a second power constraining section located at one side of the second grounding constraining section that is distant from the command reset constraining section, a second signal constraining section located at one side of the second power constraining section that is distant from the second grounding constraining section, a sixth grounding constraining section located at one side of the second signal constraining section that is distant from the second power constraining section, a first differential group constraining section located at one side of the sixth grounding constraining section that is distant from the second signal constraining section, a backup constraining section located at one side of the first signal constraining section, a first grounding constraining section located at one side of the backup constraining section, a second differential group constraining section located at one side of the first grounding constraining section, a third grounding constraining section located at one side of the second differential group constraining section that is distant from the first grounding constraining section, a first power constraining section located at one side of the third grounding constraining section that is distant from the second differential group constraining section, a third differential group constraining section located at one side of the first power constraining section that is distant from the third grounding constraining section, a fifth grounding constraining section located at one side of the third differential group constraining section that is distant from the first power constraining section, a seventh grounding constraining section located at one side of the first grounding constraining section that is distant from the third differential group constraining section, an eighth grounding constraining section located at one side of the first grounding constraining section, a fourth differential group constraining section located at one side of the eighth grounding constraining section, a ninth grounding constraining section located at one side of the fourth differential group constraining section that is distant from the eighth grounding constraining section, a third power constraining section located at one side of the ninth grounding constraining section that is distant from the fourth differential group constraining section, a fifth differential group constraining section located at one side of the third power constraining section that is distant from the ninth grounding constraining section, and a tenth grounding constraining section located at one side of the fifth differential group constraining section that is distant from the third power constraining section.

5. The card connector according to claim 1, wherein an insulative plastic body is arranged outside the transmission conductor assembly, and a shielding case is arranged outside the insulative plastic body, wherein the insulative plastic body comprises a first insulative plastic body arranged outside the first conductor group, and a second insulative plastic body arranged outside the second conductor group, wherein the first insulative plastic body is provided with a first signal constraining section, an inspection signal constraining section located at one side of the first signal constraining section, a command reset constraining section located at one side of the inspection signal constraining section that is distant from the first signal constraining section, a second grounding constraining section located at one side of the command reset constraining section that is distant from the inspection signal constraining section, a second power constraining section located at one side of the second grounding constraining section that is distant from the command reset constraining section, a second signal constraining section located at one side of the second power constraining section that is distant from the second grounding constraining section, a sixth grounding constraining section located at one side of the second signal constraining section that is distant from the second power constraining section, a first differential group constraining section located at one side of the sixth grounding constraining section that is distant from the second signal constraining section, a backup constraining section located at one side of the first signal constraining section, a first grounding constraining section located at one side of the backup constraining section, a second differential group constraining section located at one side of the first grounding constraining section, a third grounding constraining section located at one side of the second differential group constraining section that is distant from the first grounding constraining section, a first power constraining section located at one side of the third grounding constraining section that is distant from the second differential group constraining section, a third differential group constraining section located at one side of the first power constraining section that is distant from the third grounding constraining section, a fifth grounding constraining section located at one side of the third differential group constraining section that is distant from the first power constraining section, and a seventh grounding constraining section located at one side of the fifth grounding constraining section that is distant from the third differential group constraining section; and the second insulative plastic body is provided with an eighth grounding constraining section, a fourth differential group constraining section located at one side of the eighth grounding constraining section, a ninth grounding constraining section located at one side of the fourth differential group constraining section that is distant from the eighth grounding constraining section, a third power constraining section located at one side of the ninth grounding constraining section that is distant from the fourth differential group constraining section, a fifth differential group constraining section located at one side of the third power constraining section that is distant from the ninth grounding constraining section, and a tenth grounding constraining section located at one side of the fifth differential group constraining section that is distant from the third power constraining section.

6. A card connector, the card connector comprising a transmission conductor assembly, wherein the transmission conductor assembly mainly comprises:

a first conductor group and a second conductor group arranged at one side of the first conductor group, wherein the first conductor group comprises:

a backup transmission conductor, wherein the backup transmission conductor has two ends that are extended to respectively form a backup soldering section and a backup spring section;

a first signal transmission conductor, wherein the first signal transmission conductor has two ends that are extended to respectively form a first signal soldering section and a first signal spring section, and the first signal soldering section is located at one side of the backup soldering section;

an inspection signal transmission conductor, wherein the inspection signal transmission conductor has two ends that are extended to respectively form an inspection signal soldering section and an inspection signal spring section, and the inspection signal soldering section is located at one side of the first signal soldering section that is distant from the backup soldering section, the inspection signal spring section is located at one side of the first signal spring section;

a first grounding transmission conductor, wherein the first grounding transmission conductor has two ends that are extended to respectively form a first grounding soldering section and a first grounding spring section, and the first grounding soldering section is located at one side of the inspection signal soldering section that is distant from the first signal soldering section, and the first grounding spring section is located at one side of the backup spring section;

a command reset transmission conductor, wherein the command reset transmission conductor has two ends that are extended to respectively form a command reset soldering section and a command reset spring section, and the command reset soldering section is located at one side of the first grounding soldering section that is distant from the inspection signal soldering section, and the command reset spring section is located at one side of the inspection signal spring section that is distant from the first signal spring section;

a first differential transmission conductor, wherein the first differential transmission conductor has two ends that are extended to respectively form a first differential soldering section and a first differential spring section, and the first differential soldering section is located at one side of the command reset soldering section that is distant from the first grounding soldering section, and the first differential spring section is located at one side of the first grounding spring section;

a second differential transmission conductor, wherein the second differential transmission conductor has two ends that are extended to respectively form a second differential soldering section and a second differential spring section, and the second differential soldering section is located at one side of the first differential soldering section that is distant from the command reset soldering section, and the second differential spring section is located at one side of the first differential spring section that is distant from the first grounding spring section;

a second grounding transmission conductor, wherein the second grounding transmission conductor has two ends that are extended to respectively form a second grounding soldering section and a second grounding spring section, and the second grounding soldering section is located at one side of the second differential soldering section that is distant from the first differential soldering section, and the second grounding spring section is located at one side of the command reset spring section that is distant from the inspection signal spring section;

a third grounding transmission conductor, wherein the third grounding transmission conductor has two ends that are extended to respectively form a third grounding soldering section and a third grounding spring section, and the third grounding soldering section is located at one side of the second grounding soldering section that is distant from the second differential soldering section, and the third grounding spring section is located at one side of the second differential spring section that is distant from the first differential spring section;

a fourth grounding transmission conductor, wherein the fourth grounding transmission conductor has two ends that are extended to respectively form a fourth grounding soldering section and a fourth grounding spring section, and the fourth grounding soldering section is located at one side of the third grounding soldering section that is distant from the second grounding soldering section, and the fourth grounding spring section is located at one side of the second grounding spring section that is distant from the command reset spring section;

a first power transmission conductor, wherein the first power transmission conductor has two ends that are extended to respectively form a first power soldering section and a first power spring section, and the first power soldering section is located at one side of the fourth grounding soldering section that is distant from the third grounding soldering section, and the first power spring section is located at one side of the third grounding spring section that is distant from the second differential spring section;

a second power transmission conductor, wherein the second power transmission conductor has two ends that are extended to respectively form a second power soldering section and a second power spring section, and the second power soldering section is located at one side of the first power soldering section that is distant from the fourth grounding soldering section, and the second power spring section is located at one side of the fourth grounding spring section that is distant from the second grounding spring section;

a third differential transmission conductor, wherein the third differential transmission conductor has two ends that are extended to respectively form a third differential soldering section and a third differential spring section, and the third differential soldering section is located at one side of the second power soldering section that is distant from the first power soldering section, and the third differential spring section is located at one side of the first power spring section that is distant from the third grounding spring section;

a fourth differential transmission conductor, wherein the fourth differential transmission conductor has two ends that are extended to respectively form a fourth differential soldering section and a fourth differential spring section, and the fourth differential soldering section is located at one side of the third differential soldering section that is distant from the second power soldering section, and the fourth differential spring section is located at one side of the third differential spring section that is distant from the first power spring section;

a second signal transmission conductor, wherein the second signal transmission conductor has two ends that are extended to respectively form a second signal soldering section and a second signal spring section, and the second signal soldering section is located at one side of the fourth differential soldering section that is distant from the third differential soldering section, and the second signal spring section is located at one side of the second power spring section that is distant from the fourth grounding spring section;

a fifth grounding transmission conductor, wherein the fifth grounding transmission conductor has two ends that are extended to respectively form a fifth grounding soldering section and a fifth grounding spring section, and the fifth grounding soldering section is located at one side of the second signal soldering section that is distant from the fourth differential soldering section, the fifth grounding spring section is located at one side of the fourth differential spring section that is distant from the third differential spring section;

a sixth grounding transmission conductor, wherein the sixth grounding transmission conductor has two ends that are extended to respectively form a sixth grounding soldering section and a sixth grounding spring section, and the sixth grounding soldering section is located at one side of the fifth grounding soldering section that is distant from the second signal soldering section, and the sixth grounding spring section is located at one side of the second signal spring section that is distant from the second power spring section;

a seventh grounding transmission conductor, wherein the seventh grounding transmission conductor has two ends that are extended to respectively form a seventh grounding soldering section and a seventh grounding spring section, and the seventh grounding soldering section is located at one side of the sixth grounding soldering section that is distant from the fifth grounding soldering section, and the seventh grounding spring section is located at one side of the fifth grounding spring section that is distant from the fourth differential spring section;

a fifth differential transmission conductor, wherein the fifth differential transmission conductor has two ends that are extended to respectively form a fifth differential soldering section and a fifth differential spring section, and the fifth differential soldering section is located at one side of the seventh grounding soldering section that is distant from the sixth grounding soldering section, and the fifth differential spring section is located at one side of the sixth grounding spring section that is distant from the second signal spring section;

a sixth differential transmission conductor, wherein the sixth differential transmission conductor has two ends that are extended to respectively form a sixth differential soldering section and a sixth differential spring section, and the sixth differential soldering section is located at one side of the fifth differential soldering section that is distant from the seventh grounding soldering section, and the sixth differential spring section is located at one side of the fifth differential spring section that is distant from the sixth grounding spring section; and a write-protection transmission conductor, wherein the write-protection transmission conductor has two ends that are extended to respectively form a write-protection grounding soldering section and a write-protection spring section, and the write-protection grounding soldering section is located at one side of the sixth differential soldering section that is distant from the fifth differential soldering section, and the write-protection spring section is located at one side of the seventh grounding spring section that is distant from the fifth grounding spring section; and the second conductor group comprises:

an eighth grounding transmission conductor, wherein the eighth grounding transmission conductor has two ends that are extended to respectively form an eighth grounding soldering section and an eighth grounding spring section;

a seventh differential transmission conductor, wherein the seventh differential transmission conductor has two ends that are extended to respectively form a seventh differential soldering section and a seventh differential spring section, and the seventh differential soldering section is located at one side of the eighth grounding soldering section, and the seventh differential spring section is located at one side of the eighth grounding spring section;

an eighth differential transmission conductor, wherein the eighth differential transmission conductor has two ends that are extended to respectively form an eighth differential soldering section and an eighth differential spring section, and the eighth differential soldering section is located at one side of the seventh differential soldering section that is distant from the eighth grounding soldering section, and the eighth differential spring section is located at one side of the seventh differential spring section that is distant from the eighth grounding spring section;

a ninth grounding transmission conductor, wherein the ninth grounding transmission conductor has two ends that are extended to respectively form a ninth grounding soldering section and a ninth grounding spring section, and the ninth grounding soldering section is located at one side of the eighth differential soldering section that is distant from the seventh differential soldering section, and the ninth grounding spring section is located at one side of the eighth differential spring section that is distant from the seventh differential spring section;

a third power transmission conductor, wherein the third power transmission conductor has two ends that are extended to respectively form a third power soldering section and a third power spring section, and the third power soldering section is located at one side of the ninth grounding soldering section that is distant from the eighth differential soldering section, and the third power spring section is located at one side of the ninth grounding spring section that is distant from the eighth differential spring section;

a ninth differential transmission conductor, wherein the ninth differential transmission conductor has two ends that are extended to respectively form a ninth differential soldering section and a ninth differential spring section, and the ninth differential soldering section is located at one side of the third power soldering section that is distant from the ninth grounding soldering section, and the ninth differential spring section is located at one side of the third power spring section that is distant from the ninth grounding spring section;

a tenth differential transmission conductor, wherein the tenth differential transmission conductor has two ends that are extended to respectively form a tenth differential soldering section and a tenth differential spring section, and the tenth differential soldering section is located at one side of the ninth differential soldering section that is distant from the third power soldering section, and the tenth differential spring section is located at one side of the ninth differential spring section that is distant from the third power spring section; and a tenth grounding transmission conductor, wherein the tenth grounding transmission conductor has two ends that are extended to respectively form a tenth grounding soldering section and a tenth grounding spring section, and the tenth grounding soldering section is located at one side of the tenth differential soldering section that is distant from the ninth differential soldering section, and the tenth grounding spring section is located at one side of the tenth differential spring section that is distant from the ninth differential spring section.

7. The card connector according to claim 6, wherein an insulative plastic body is arranged outside the transmission conductor assembly, and a shielding case is arranged outside the insulative plastic body, wherein the insulative plastic body is provided with a first signal constraining section, an inspection signal constraining section located at one side of the first signal constraining section, a command reset constraining section located at one side of the inspection signal constraining section that is distant from the first signal constraining section, a second grounding constraining section located at one side of the command reset constraining section that is distant from the inspection signal constraining section, a second power constraining section located at one side of the second grounding constraining section that is distant from the command reset constraining section, a second signal constraining section located at one side of the second power constraining section that is distant from the second grounding constraining section, a sixth grounding constraining section located at one side of the second signal constraining section that is distant from the second power constraining section, a first differential group constraining section located at one side of the sixth grounding constraining section that is distant from the second signal constraining section, a backup constraining section located at one side of the first signal constraining section, a first grounding constraining section located at one side of the backup constraining section, a second differential group constraining section located at one side of the first grounding constraining section, a third grounding constraining section located at one side of the second differential group constraining section that is distant from the first grounding constraining section, a first power constraining section located at one side of the third grounding constraining section that is distant from the second differential group constraining section, a third differential group constraining section located at one side of the first power constraining section that is distant from the third grounding constraining section, a fifth grounding constraining section located at one side of the third differential group constraining section that is distant from the first power constraining section, a seventh grounding constraining section located at one side of the first grounding constraining section that is distant from the third differential group constraining section, an eighth grounding constraining section located at one side of the first grounding constraining section, a fourth differential group constraining section located at one side of the eighth grounding constraining section, a ninth grounding constraining section located at one side of the fourth differential group constraining section that is distant from the eighth grounding constraining section, a third power constraining section located at one side of the ninth grounding constraining section that is distant from the fourth differential group constraining section, a fifth differential group constraining section located at one side of the third power constraining section that is distant from the ninth grounding constraining section, and a tenth grounding constraining section located at one side of the fifth differential group constraining section that is distant from the third power constraining section.

8. The card connector according to claim 6, wherein an insulative plastic body is arranged outside the transmission conductor assembly, and a shielding case is arranged outside the insulative plastic body, wherein the insulative plastic body comprises a first insulative plastic body arranged outside the first conductor group, and a second insulative plastic body arranged outside the second conductor group, and the shielding case comprises a first shielding case arranged outside the first insulative plastic body, and a second shielding case arranged outside the second insulative plastic body, wherein the first insulative plastic body is provided with a first signal constraining section, an inspection signal constraining section located at one side of the first signal constraining section, a command reset constraining section located at one side of the inspection signal constraining section that is distant from the first signal constraining section, a second grounding constraining section located at one side of the command reset constraining section that is distant from the inspection signal constraining section, a second power constraining section located at one side of the second grounding constraining section that is distant from the command reset constraining section, a second signal constraining section located at one side of the second power constraining section that is distant from the second grounding constraining section, a sixth grounding constraining section located at one side of the second signal constraining section that is distant from the second power constraining section, a first differential group constraining section located at one side of the sixth grounding constraining section that is distant from the second signal constraining section, a backup constraining section located at one side of the first signal constraining section, a first grounding constraining section located at one side of the backup constraining section, a second differential group constraining section located at one side of the first grounding constraining section, a third grounding constraining section located at one side of the second differential group constraining section that is distant from the first grounding constraining section, a first power constraining section located at one side of the third grounding constraining section that is distant from the second differential group constraining section, a third differential group constraining section located at one side of the first power constraining section that is distant from the third grounding constraining section, a fifth grounding constraining section located at one side of the third differential group constraining section that is distant from the first power constraining section, and a seventh grounding constraining section located at one side of the fifth grounding constraining section that is distant from the third differential group constraining section; and the second insulative plastic body is provided with an eighth grounding constraining section, a fourth differential group constraining section located at one side of the eighth grounding constraining section, a ninth grounding constraining section located at one side of the fourth differential group constraining section that is distant from the eighth grounding constraining section, a third power constraining section located at one side of the ninth grounding constraining section that is distant from the fourth differential group constraining section, a fifth differential group constraining section located at one side of the third power constraining section that is distant from the ninth grounding constraining section, and a tenth grounding constraining section located at one side of the fifth differential group constraining section that is distant from the third power constraining section.

9. The card connector according to claim 6, wherein an insulative plastic body is arranged outside the transmission conductor assembly, and a shielding case is arranged outside the insulative plastic body, wherein the shielding case comprises a first shielding case arranged outside the first conductor group, and a second shielding case arranged outside the second conductor group, wherein the insulative plastic body is provided with a first signal constraining section, an inspection signal constraining section located at one side of the first signal constraining section, a command reset constraining section located at one side of the inspection signal constraining section that is distant from the first signal constraining section, a second grounding constraining section located at one side of the command reset constraining section that is distant from the inspection signal constraining section, a second power constraining section located at one side of the second grounding constraining section that is distant from the command reset constraining section, a second signal constraining section located at one side of the second power constraining section that is distant from the second grounding constraining section, a sixth grounding constraining section located at one side of the second signal constraining section that is distant from the second power constraining section, a first differential group constraining section located at one side of the sixth grounding constraining section that is distant from the second signal constraining section, a backup constraining section located at one side of the first signal constraining section, a first grounding constraining section located at one side of the backup constraining section, a second differential group constraining section located at one side of the first grounding constraining section, a third grounding constraining section located at one side of the second differential group constraining section that is distant from the first grounding constraining section, a first power constraining section located at one side of the third grounding constraining section that is distant from the second differential group constraining section, a third differential group constraining section located at one side of the first power constraining section that is distant from the third grounding constraining section, a fifth grounding constraining section located at one side of the third differential group constraining section that is distant from the first power constraining section, a seventh grounding constraining section located at one side of the first grounding constraining section that is distant from the third differential group constraining section, an eighth grounding constraining section located at one side of the first grounding constraining section, a fourth differential group constraining section located at one side of the eighth grounding constraining section, a ninth grounding constraining section located at one side of the fourth differential group constraining section that is distant from the eighth grounding constraining section, a third power constraining section located at one side of the ninth grounding constraining section that is distant from the fourth differential group constraining section, a fifth differential group constraining section located at one side of the third power constraining section that is distant from the ninth grounding constraining section, and a tenth grounding constraining section located at one side of the fifth differential group constraining section that is distant from the third power constraining section.

10. The card connector according to claim 6, wherein an insulative plastic body is arranged outside the transmission conductor assembly, and a shielding case is arranged outside the insulative plastic body, wherein the insulative plastic body comprises a first insulative plastic body arranged outside the first conductor group, and a second insulative plastic body arranged outside the second conductor group, wherein the first insulative plastic body is provided with a first signal constraining section, an inspection signal constraining section located at one side of the first signal constraining section, a command reset constraining section located at one side of the inspection signal constraining section that is distant from the first signal constraining section, a second grounding constraining section located at one side of the command reset constraining section that is distant from the inspection signal constraining section, a second power constraining section located at one side of the second grounding constraining section that is distant from the command reset constraining section, a second signal constraining section located at one side of the second power constraining section that is distant from the second grounding constraining section, a sixth grounding constraining section located at one side of the second signal constraining section that is distant from the second power constraining section, a first differential group constraining section located at one side of the sixth grounding constraining section that is distant from the second signal constraining section, a backup constraining section located at one side of the first signal constraining section, a first grounding constraining section located at one side of the backup constraining section, a second differential group constraining section located at one side of the first grounding constraining section, a third grounding constraining section located at one side of the second differential group constraining section that is distant from the first grounding constraining section, a first power constraining section located at one side of the third grounding constraining section that is distant from the second differential group constraining section, a third differential group constraining section located at one side of the first power constraining section that is distant from the third grounding constraining section, a fifth grounding constraining section located at one side of the third differential group constraining section that is distant from the first power constraining section, and a seventh grounding constraining section located at one side of the fifth grounding constraining section that is distant from the third differential group constraining section; and the second insulative plastic body is provided with an eighth grounding constraining section, a fourth differential group constraining section located at one side of the eighth grounding constraining section, a ninth grounding constraining section located at one side of the fourth differential group constraining section that is distant from the eighth grounding constraining section, a third power constraining section located at one side of the ninth grounding constraining section that is distant from the fourth differential group constraining section, a fifth differential group constraining section located at one side of the third power constraining section that is distant from the ninth grounding constraining section, and a tenth grounding constraining section located at one side of the fifth differential group constraining section that is distant from the third power constraining section.

* * * * *